US011531294B2

(12) United States Patent
Yoshida et al.

(10) Patent No.: US 11,531,294 B2
(45) Date of Patent: Dec. 20, 2022

(54) IMAGE FORMING APPARATUS INCLUDING A PLURALITY OF HEAT GENERATING ELEMENTS

(71) Applicant: CANON KABUSHIKI KAISHA, Tokyo (JP)

(72) Inventors: Tsuguhiro Yoshida, Yokohama (JP); Kohei Wakatsu, Kawasaki (JP); Kazuhiro Doda, Yokohama (JP); Yutaka Sato, Komae (JP); Ken Nakagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/537,235

(22) Filed: Nov. 29, 2021

(65) Prior Publication Data

US 2022/0082969 A1 Mar. 17, 2022

Related U.S. Application Data

(63) Continuation of application No. 17/011,586, filed on Sep. 3, 2020, now Pat. No. 11,221,575.

(30) Foreign Application Priority Data

Sep. 6, 2019 (JP) ..... JP2019-162955

(51) Int. Cl.
*G03G 15/20* (2006.01)

(52) U.S. Cl.
CPC ..... *G03G 15/2053* (2013.01); *G03G 15/205* (2013.01); *G03G 15/2021* (2013.01); *G03G 2215/00329* (2013.01); *G03G 2215/00679* (2013.01); *G03G 2215/00734* (2013.01); *G03G 2215/00772* (2013.01)

(58) Field of Classification Search
CPC ..... G03G 15/2053; G03G 15/2021; G03G 15/205; G03G 2215/00329; G03G 2215/00679; G03G 2215/00734; G03G 2215/00772; G03G 15/2042; G03G 15/2064; G03G 2215/2035
See application file for complete search history.

(56) References Cited

U.S. PATENT DOCUMENTS

2018/0081308 A1* 3/2018 Cao ..... G03G 15/80

* cited by examiner

*Primary Examiner* — Susan S Lee
(74) *Attorney, Agent, or Firm* — Canon U.S.A., Inc. I.P. Division

(57) ABSTRACT

An image forming apparatus includes a fixing device having a heater, a first temperature detection unit, a pair of second temperature detection units, a pair of first sheet-width detection units, a pair of second sheet-width detection units, and a control unit. The heater includes a first heat generating element, a second heat generating element having a length smaller than a length of the first heat generating element in a longitudinal direction, and a third heat generating element having a length smaller than the length of the second heat generating element in the longitudinal direction. The control unit controls a temperature of the heater based on a detection result of the pair of first sheet-width detection units, a detection result of the pair of second sheet-width detection units, and a detection result of the pair of second temperature detection units.

25 Claims, 9 Drawing Sheets

IMAGE FORMING APPARATUS INCLUDING A PLURALITY OF HEAT GENERATING ELEMENTS

CROSS REFERENCE TO RELATED APPLICATIONS

This application is a continuation of U.S. patent application Ser. No. 17/011,586, filed on Sep. 3, 2020, which claims priority from Japanese Patent Application No. 2019-162955, filed Sep. 6, 2019, each of which are hereby incorporated by reference herein in their entirety.

BACKGROUND

Field of the Disclosure

The present disclosure relates to an image forming apparatus employing electrophotography, for example, a copying machine or a printer.

Description of the Related Art

When sheets each having a width smaller than that of a heater are subjected to continuous printing in a fixing device, there occurs a phenomenon called a "non-sheet passing portion temperature rise", in which the temperature of the fixing device is gradually increased in a region in a longitudinal direction of the fixing device through which the sheets do not pass. When the non-sheet passing portion temperature rise becomes conspicuous, components of the fixing device, such as a film and a pressure roller, may be damaged in some cases. In order to prevent the non-sheet passing portion temperature rise, there has been proposed a configuration in which a plurality of heat generating elements having different lengths are provided, and a heat generating element is selected in accordance with the sheet width of each sheet, to thereby reduce the non-sheet passing portion temperature rise. For example, in Japanese Patent Application Laid-Open No. 2000-162919, there is disclosed a configuration including a plurality of heat generating elements having different lengths, a first sheet-width sensor, and a second sheet-width sensor. There is also disclosed a configuration in which an appropriate heat generating element and throughput (printed number of sheets per unit time) are selected based on detection results of the first sheet-width sensor and the second sheet-width sensor.

However, in the related-art system, temperature unevenness may occur in the longitudinal direction of the fixing device. For example, when there occurs "sheet size mismatch", in which the sheet width of a sheet designated by a user is different from the actual detection results of the sheet-width sensors, an appropriate heat generating element is not selected, and thus, shortage of supply of heat (power) may occur in an end portion of the sheet in some cases.

SUMMARY

According to an aspect of the present disclosure, an image forming apparatus includes a fixing device including a heater that includes a first heat generating element, a second heat generating element having a length smaller than a length of the first heat generating element in a longitudinal direction, and a third heat generating element having a length smaller than the length of the second heat generating element in the longitudinal direction, a first temperature detection unit provided at a position corresponding to a center of the first heat generating element in the longitudinal direction, a control unit configured to control a temperature of the heater based on a detection result of the first temperature detection unit, a pair of second temperature detection units provided at positions corresponding to both ends of the third heat generating element, a pair of first sheet-width detection units, which are provided upstream of the fixing device in a conveyance direction of a recording material, and which are provided at positions corresponding to both ends of the first heat generating element, a pair of second sheet-width detection units, which are provided upstream of the fixing device in the conveyance direction, and which are provided at positions corresponding to both ends of the second heat generating element, and a determination unit configured to determine a width of the recording material based on a detection result of the pair of first sheet-width detection units, a detection result of the pair of second sheet-width detection units, and a detection result of the pair of second temperature detection units.

Further features and aspects of the present disclosure will become apparent from the following description of exemplary embodiments with reference to the attached drawings.

DESCRIPTION OF THE EMBODIMENTS

The embodiments of the present disclosure are described below with reference to the drawings. In the following embodiments, running a recording sheet through a fixing nip portion is referred to as "passing a sheet". An area in which a heat generating element generates heat and through which a recording sheet does not pass is referred to as "non-sheet passing area" (or "non-sheet passing portion"). An area in which a heat generating element generates heat and through which a recording sheet passes is referred to as "sheet passing area" (or "sheet passing portion"). A phenomenon in which the temperature in the non-sheet passing area rises higher than the temperature in the sheet passing area is referred to as "temperature rise in a non-sheet passing portion".

Embodiment 1

[Image Forming Apparatus]

Figure 1:
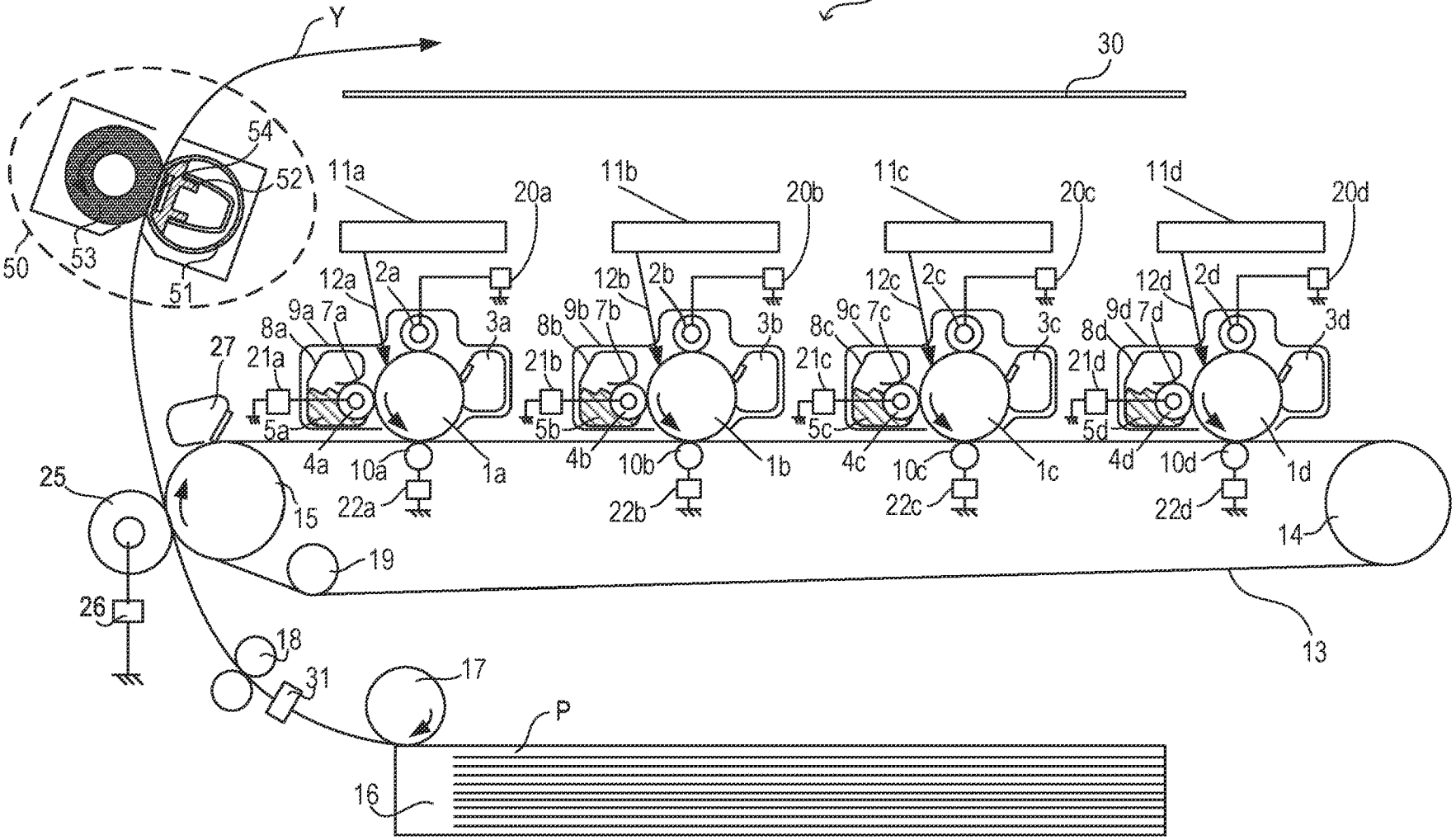
FIG. 1 is a configuration diagram of an image forming apparatus according to Embodiments 1 and 2.

FIG. 1 is a configuration diagram of an in-line color-image forming apparatus 170, which is an example of an image forming apparatus with a fixing device installed therein according to Embodiment 1. The operation of the color-image forming apparatus 170 as an electrophotographic apparatus is described with reference to FIG. 1. A first station is a station for forming a yellow (Y) color toner image, and a second station is a station for forming a magenta (M) color toner image. A third station is a station for forming a cyan (C) color toner image, and a fourth station is a station for forming a black (K) color toner image.

At the first station, a photosensitive drum 1*a*, which is an image bearing member, is an organic photoconductor (OPC) photosensitive drum. The photosensitive drum 1*a* is a metal cylinder on which a plurality of layers of functional organic materials are laminated. The plurality of layers include a carrier generation layer, which generates electric charges by photosensitivity, a charge transport layer, through which the generated electric charges are transported, and others, and the outermost layer of the plurality of layers is so low in electrical conductance that the outermost layer is substantially insulating. A charging roller 2*a*, which is a charging unit, is brought into contact with the photosensitive drum 1*a*, and follows the rotation of the photosensitive drum 1*a* to rotate and uniformly charge a surface of the photosensitive drum 1*a* during the rotation. A voltage on which a DC voltage or an AC voltage is superposed is applied to the charging roller 2*a*, and the resultant electric discharge occurring in minute air gaps on the upstream side and the downstream side in the direction of the rotation from a nip portion between the charging roller 2*a* and the surface of the photosensitive drum 1*a* charges the photosensitive drum 1*a*. A cleaning unit 3*a* is a unit configured to clean toner remaining on the photosensitive drum 1*a* after transfer, which is described later. A developing unit 8*a*, which is a unit configured to develop an image, includes a developing roller 4*a*, a non-magnetic one-component toner 5*a*, and a developer application blade 7*a*. The photosensitive drum 1*a*, the charging roller 2*a*, the cleaning unit 3*a*, and the developing unit 8*a* are in an integrated process cartridge 9*a*, which can freely be attached to and detached from the image forming apparatus 170 without meaningful restriction.

An exposure device 11*a*, which is an exposure unit, includes a scanner unit using a polygonal mirror to scan laser light, or a light emitting diode (LED) array, and radiates a scanning beam 12*a*, which is modulated based on an image signal, on the photosensitive drum 1*a*. The charging roller 2*a* is connected to a charging high-voltage power source 20*a*, which is a unit configured to supply a voltage to the charging roller 2*a*. The developing roller 4*a* is connected to a development high-voltage power source 21*a*, which is a unit configured to supply a voltage to the developing roller 4*a*. A primary transfer roller 10*a* is connected to a primary transfer high-voltage power source 22*a*, which is a unit configured to supply a voltage to the primary transfer roller 10*a*. This concludes the description on the configuration of the first station, and the second, third, and fourth stations have the same configuration as that of the first station. In the other stations, parts having the same functions as those of the parts in the first station are denoted by the same reference symbols, with one of suffixes "b", "c", and "d" attached to the reference symbols for each station. The suffixes "a", "b", "c", and "d" are omitted in the following description, except for when a specific station is described.

An intermediate transfer belt 13 is supported by three rollers: a secondary transfer counter roller 15, a tension roller 14, and an auxiliary roller 19, which serve as tension members for the intermediate transfer belt 13. A force from a spring is applied to the tension roller 14 alone in a direction that causes the intermediate transfer belt 13 to stretch, so that an appropriate tensional force is maintained in the intermediate transfer belt 13. The secondary transfer counter roller 15 is rotationally driven by a main motor (not shown) to rotate, which causes the intermediate transfer belt 13 wound around the outer circumference of the secondary transfer counter roller 15 to turn. The intermediate transfer belt 13 moves in a forward direction (for example, the clockwise direction in FIG. 1) in relation to the photosensitive drums 1*a* to 1*d* (rotating, for example, in the counterclockwise direction in FIG. 1) at substantially the same speed. The intermediate transfer belt 13 also rotates in the direction of the arrow (the clockwise direction), and the primary transfer roller 10 placed on the opposite side from the photosensitive drum 1 across the intermediate transfer belt 13 follows the movement of the intermediate transfer belt 13 to rotate. A position at which the photosensitive drum 1 and the primary transfer roller 10 come into contact with each other with the intermediate transfer belt 13 interposed therebetween is referred to as "primary transfer position". The auxiliary roller 19, the tension roller 14, and the secondary transfer counter roller 15 are electrically grounded. The primary transfer rollers 10*b* to 10*d* in the second to fourth stations have the same configuration as that of the primary transfer roller 10*a* in the first station, and description thereof is therefore omitted.

Image forming operation of the image forming apparatus 170 according to Embodiment 1 is described next. The image forming apparatus 170 starts image forming operation when receiving a print command in a standby state. The main motor (not shown) causes the photosensitive drums 1, the intermediate transfer belt 13, and others to start rotating in the directions of the arrows at a predetermined process speed. The photosensitive drum 1*a* is uniformly charged by the charging roller 2*a*, to which a voltage has been applied by the charging high-voltage power source 20*a*, and an electrostatic latent image based on image information is subsequently formed with the scanning beam 12*a* radiated from the exposure device 11*a*. The toner 5*a* inside the developing unit 8*a* is charged to have a negative polarity by the developer application blade 7*a*, and then applied to the developing roller 4*a*. A predetermined development voltage is supplied to the developing roller 4*a* from the development high-voltage power source 21*a*. With the rotation of the photosensitive drum 1*a*, the electrostatic latent image formed on the photosensitive drum 1*a* reaches the developing roller 4*a*, at which the negative toner adheres to the electrostatic latent image, to thereby turn the electrostatic latent image into a visible toner image that is formed in the first color (for example, yellow (Y)) on the photosensitive drum 1*a*. The same operation is executed at the stations (the process cartridges 9*b* to 9*d*) of the other colors (magenta (M), cyan (C), and black (K)) as well. An electrostatic latent image is formed on each of the photosensitive drums 1*a* to 1*d* by exposure, with a write signal from a controller (not shown) delayed at fixed timing that is based on the distance between the primary transfer position of one color and the primary transfer position of another color. A DC high voltage having a polarity opposite to that of the toner is applied to each of the primary transfer rollers 10*a* to 10*d*. Through the steps described above, toner images are sequentially transferred to the intermediate transfer belt 13 (hereinafter referred to as "primary transfer") to form a multiple toner image on the intermediate transfer belt 13.

Thereafter, a sheet P, which is one of recording materials stacked in a feed cassette 16, is conveyed along a conveyance path Y with the progress of the forming of toner images. Specifically, the sheet P is fed (picked up) by a sheet feeding roller 17, which is rotationally driven by a sheet feeding solenoid (not shown). In this case, depending on the case in which the sheet P passes through (cuts through) a plurality of sheet-width sensors 31 serving as sheet-width detection units or the case in which the sheet P does not pass through (does not cut through) the sheet-width sensors 31, ON/OFF signals of the sheet-width sensors 31 are output to a CPU 94 described later. The CPU 94 is configured to determine a sheet width of the sheet P based on detection results of the sheet-width sensors 31. In this case, the sheet width refers to a length in a direction substantially orthogonal to a conveyance direction of the sheet P, that is, a length in a longitudinal direction of a heat generating element 54*b* described later. The sheet-width sensor 31 is described later in detail.

The fed sheet P is conveyed by a conveying roller to registration rollers 18. The sheet P is conveyed by the registration rollers 18 to a transfer nip portion at which the intermediate transfer belt 13 and the secondary transfer roller 25 come into contact with each other, in synchronization with the toner image on the intermediate transfer belt 13. A voltage having a polarity opposite to that of the toner is applied to the secondary transfer roller 25 by the secondary transfer high-voltage power source 26 to transfer the multiple toner image borne on the intermediate transfer belt 13, which is a stack of toner images each having one of four colors, at once onto the sheet P (a recording material) (hereinafter referred to as "secondary transfer"). The members that have participated up through the forming of an unfixed toner image on the sheet P (for example, the photosensitive drums 1) function as an image forming unit. The toner remaining on the intermediate transfer belt 13 after the secondary transfer is finished is cleaned off by the cleaning unit 27. The sheet P after the completion of the secondary transfer is conveyed to a fixing device 50, which is a fixing unit, and once the toner image is fixed, is discharged as an image-formed product (a print or a copy) to a discharge tray 30. A film 51, nip forming member 52, pressure roller 53, and heater 54 of the fixing device 50 are described later.

[Block Diagram of Image Forming Apparatus]

Figure 2:
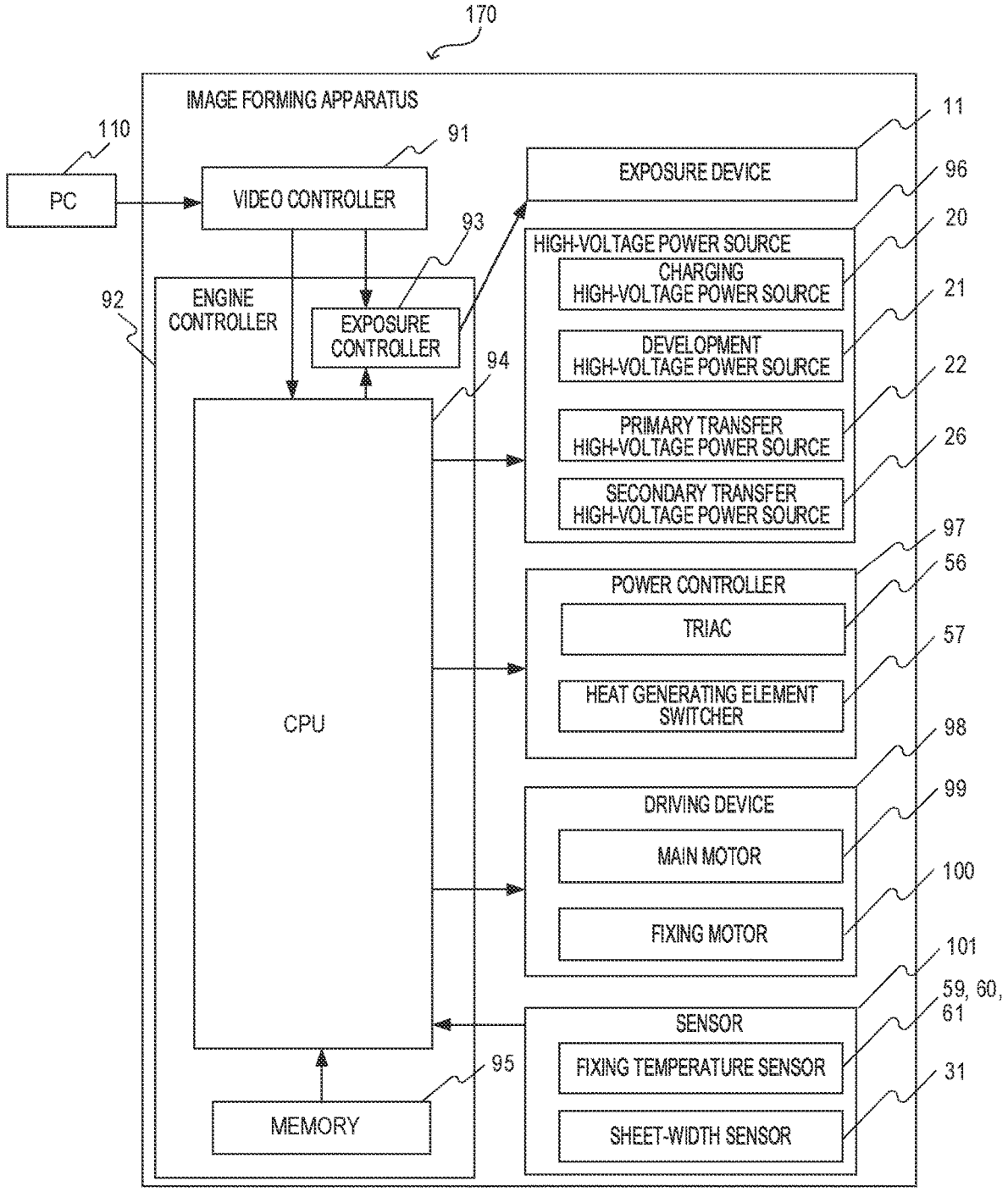
FIG. 2 is a block diagram of the image forming apparatus of Embodiments 1 and 2.

FIG. 2 is a block diagram for illustrating the operation of the image forming apparatus 170. Printing operation of the image forming apparatus 170 is described with reference to FIG. 2. A PC 110 serving as a host computer has the role of outputting a print command to a video controller 91, which is located inside the image forming apparatus 170, and transferring image data of a print image to the video controller 91. In this case, a size of image data (hereinafter referred to as "image size") is determined in accordance with a sheet size designated by the PC 110 serving a designation unit (hereinafter referred to as "designated sheet size"). A sheet size input from an input portion (not shown) included in the image forming apparatus 170 may be set as the designated sheet size, and in this case, the input portion corresponds to the designation unit. In Embodiment 1, an image size is obtained by subtracting a total of both sheet end margins of 10 mm (each sheet end margin: 5 mm) from the designated sheet size.

The video controller 91 is configured to convert the image data input from the PC 110 into exposure data, and transfer the exposure data to an exposure controller 93 located inside the engine controller 92. The exposure controller 93 is controlled by a CPU 94 to control the on/off of the exposure data and the exposure device 11. The size of the exposure data is determined by the image size. The CPU 94, which is a control unit, starts an image forming sequence when receiving the print command.

An engine controller 92 in which a CPU 94, a memory 95, and others are installed is configured to execute pre-programmed operation. A high-voltage power source 96 includes the charging high-voltage power source 20, development high-voltage power source 21, primary transfer high-voltage power source 22, and secondary transfer high-voltage power source 26 described above. In addition, a power controller 97 is formed of, for example, a bidirectional thyristor (hereinafter referred to as "triac") 56, and a heat generating element switcher 57, which serves as a switching unit configured to exclusively select a heat generating element to which power is to be supplied. The power controller 97 is configured to select a heat generating element that generates heat in the fixing device 50, and determine the amount of power to be supplied. A driving device 98 includes a main motor 99, a fixing motor 100, and others. A sensor 101 includes fixing temperature sensors 59, 60, and 61, which are configured to detect the temperature of the fixing device 50, the sheet-width sensor 31, which is configured to detect the width of the sheet P, and others. Detection results of the sensor 101 are transmitted to the CPU 94. The CPU 94 obtains the detection results of the sensor 101 in the image forming apparatus 170 to control the exposure device 11, the high-voltage power source 96, the power controller 97, and the driving device 98. The CPU 94 thus controls an image forming step in which the forming of an electrostatic latent image, the transfer of a developed toner image, and the fixing of the toner image to the sheet P are executed to print exposure data as a toner image on the sheet P. An image forming apparatus to which Embodiment 1 is applied is not limited to the image forming apparatus 170 that has the configuration illustrated in FIG. 1, and can be any image forming apparatus as long as printing on sheets P of varying widths is executable and the image forming apparatus includes the fixing device 50 that includes the heater 54 described later.

[Fixing Device]

Figure 3:
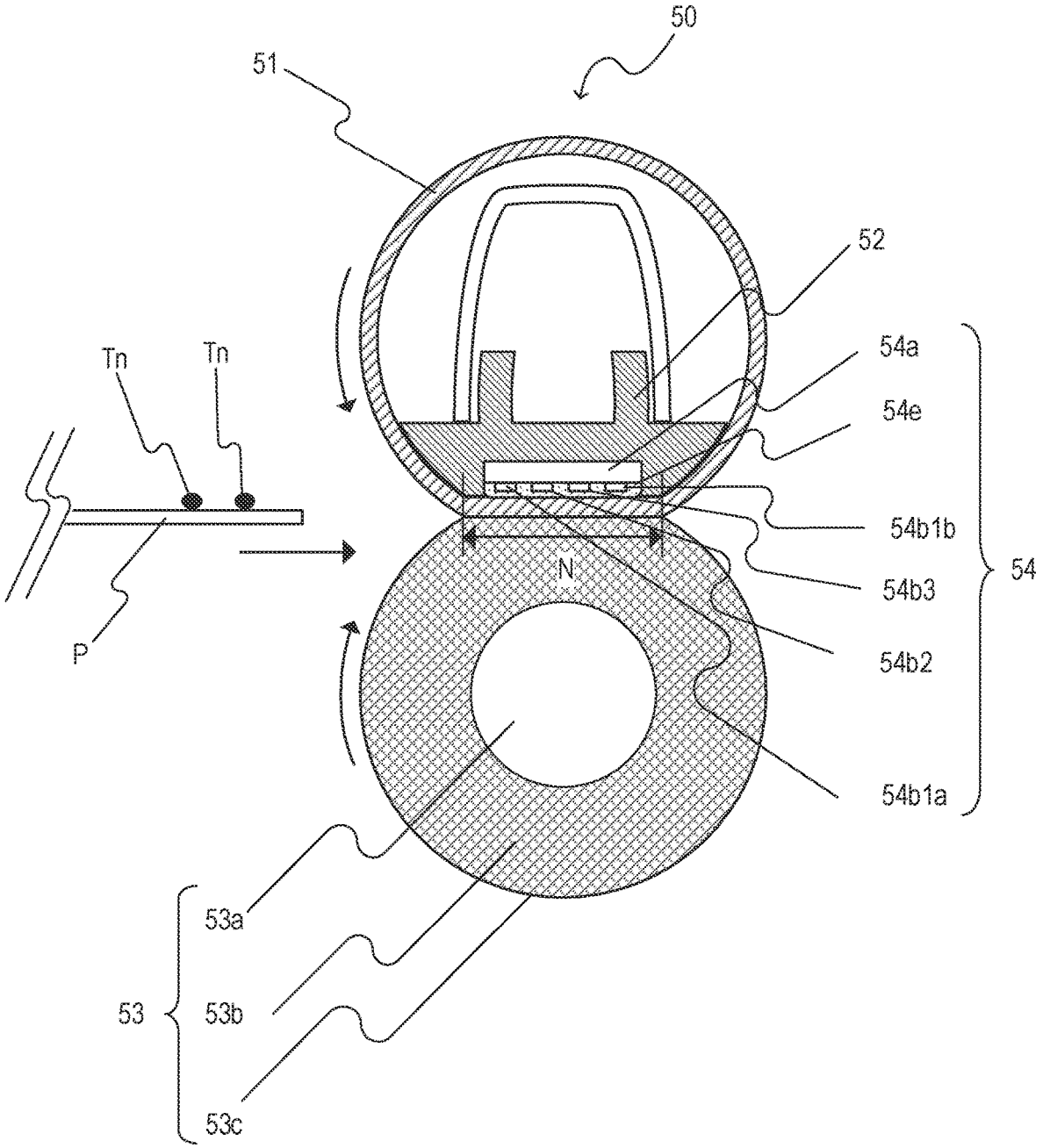
FIG. 3 is a schematic sectional view of a fixing device in Embodiments 1 and 2.
Figure 4A:
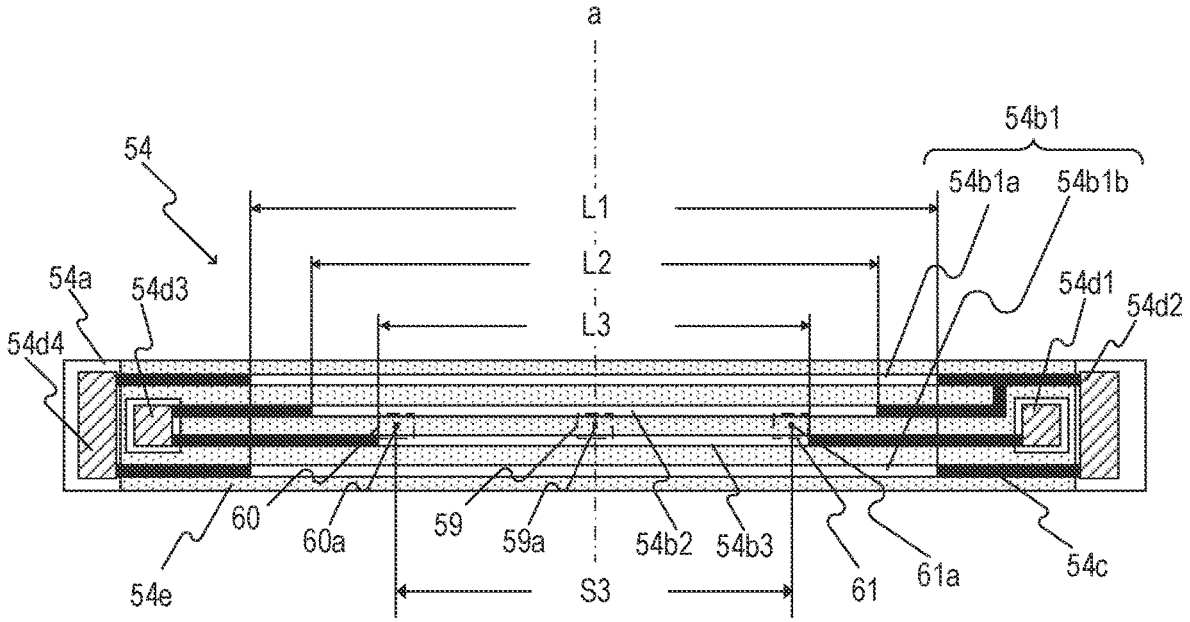
FIG. 4A is a schematic view of a heater in Embodiment 1.
Figure 4B:
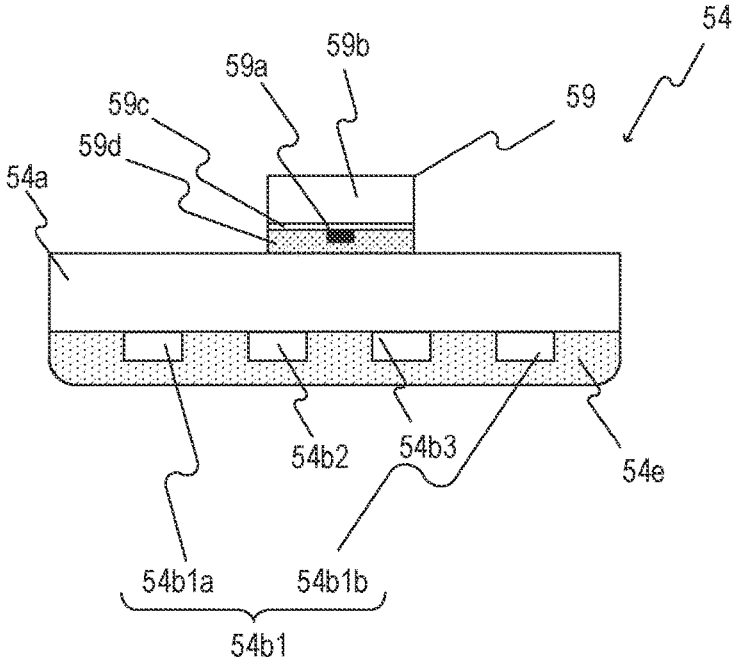
FIG. 4B is a schematic sectional view of the heater in Embodiment 1.
Figure 5:
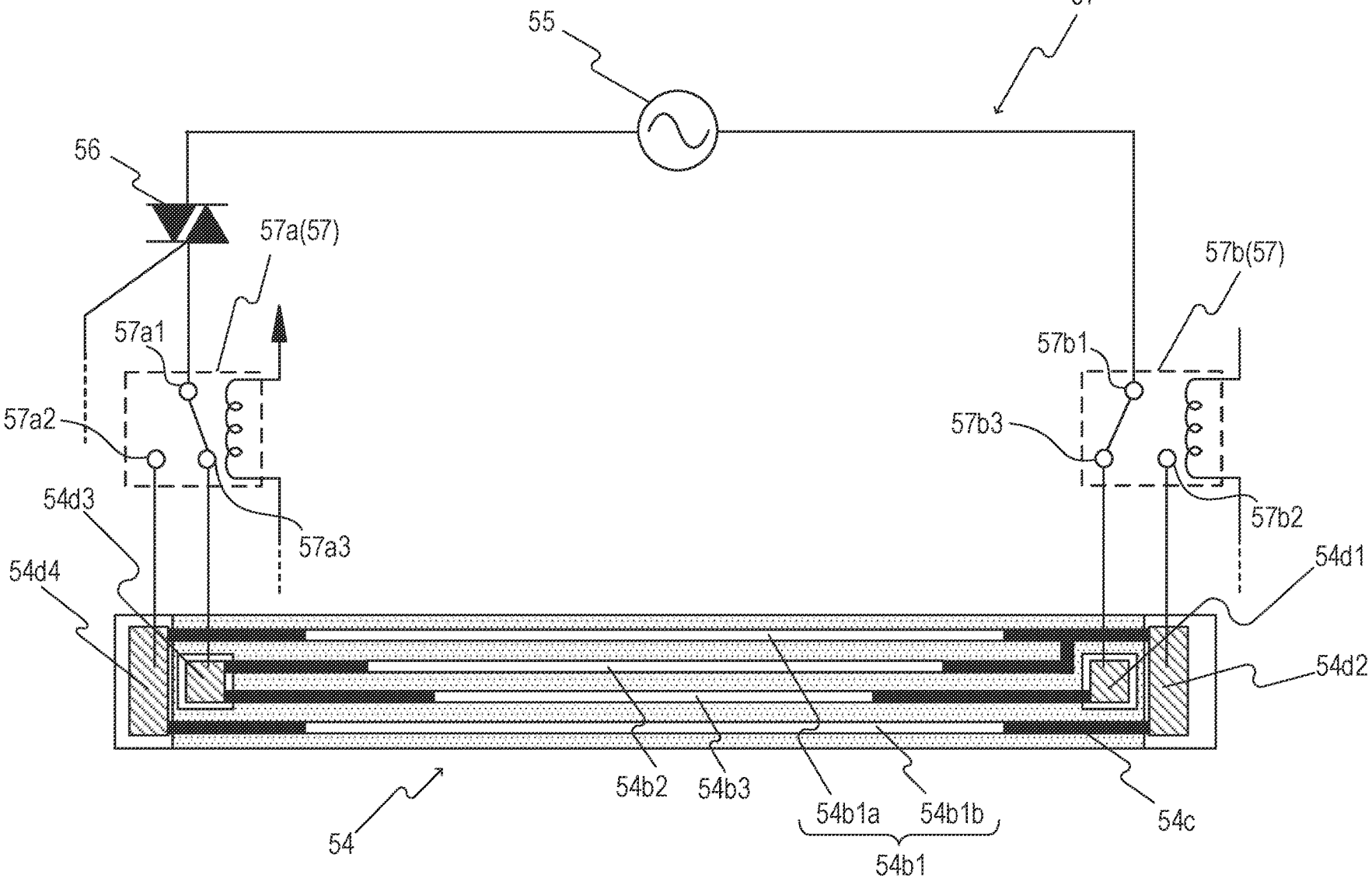
FIG. 5 is a schematic view of a power control circuit of the fixing device in Embodiment 1.

A configuration of the fixing device 50 in Embodiment 1 is described next with reference to FIG. 3. The longitudinal direction is a rotation axis direction of the pressure roller 53 described later, which is substantially orthogonal to the conveyance direction of the sheet P. The length of the sheet P in the direction (the longitudinal direction) substantially orthogonal to the conveyance direction is referred to as "width". FIG. 3 is a schematic sectional view of the fixing device 50. FIG. 4A is a schematic view of the heater 54, FIG. 4B is a schematic sectional view of the heater 54, and FIG. 5 is a schematic circuit diagram of the power controller 97 of the heater 54 of the fixing device 50. FIG. 4B is a sectional view of the heater 54 taken along a center line of heat generating elements 54*b*1*a*, 54*b*1*b*, 54*b*2 and 54*b*3 in the longitudinal direction, which is a center line (the dot-dash line "a" in FIG. 4A) of the sheet P conveyed to the fixing device 50 in the longitudinal direction. In the following description, the line "a" is referred to as "reference line "a".

The sheet P holding an unfixed toner image Tn is conveyed from the left hand side toward the right hand side in FIG. 3, and is heated in a fixing nip portion N during the conveyance, to thereby fix the toner image Tn on the sheet P. The fixing device 50 in Embodiment 1 includes the film 51 shaped into a tube, the nip forming member 52 configured to hold the film 51, the pressure roller 53, which forms the fixing nip portion N together with the film 51, and the heater 54 for heating the sheet P.

The film 51, which is a first rotary member, is a fixing film serving as a heating rotary member. In Embodiment 1, the film 51 has a base layer made of, for example, polyimide. On the base layer, an elastic layer is made of silicone rubber and a release layer is made of perfluoroalkoxy polymer resin (PFA). The inner surface of the film 51 is coated with grease in order to reduce a frictional force generated between the nip forming member 52, the heater 54, and the film 51 by the rotation of the film 51.

The nip forming member 52 plays the role of guiding the film 51 from the inside and forming the fixing nip portion N between the nip forming member 52 and the pressure roller 53 via the film 51. The nip forming member 52 is a member that has rigidity, heat resistance, and heat insulation, and is formed of liquid crystal polymer or the like. The film 51 is fit to the exterior of the nip forming member 52. The pressure roller 53, which is a second rotary member, is a roller serving as a pressurizing rotary member. The pressure roller 53 includes a metal core 53*a*, an elastic layer 53*b*, and a release layer 53*c*. The pressure roller 53 is rotatably held at both ends, and is rotationally driven by the fixing motor 100 (see FIG. 2). The film 51 follows the rotation of the pressure roller 53 to rotate. The heater 54, which is a heating member, is held by the nip forming member 52 so as to be in contact with the inner surface of the film 51. A substrate 54*a*, the heat generating elements 54*b*1*a* (54*b*1), 54*b*1*b* (54*b*1), 54*b*2, and 54*b*3, a protection glass layer 54*e*, and the fixing temperature sensors 59, 60, and 61 are described later.

(Heater)

The heater 54 is described in detail with reference to FIG. 4A. The heater 54 is formed of a substrate 54*a*, the heat generating element 54*b*1*a* being a first heat generating element, the heat generating element 54*b*1*b* being a fourth heat generating element, the heat generating element 54*b*2 being a second heat generating element, the heat generating element 54*b*3 being a third heat generating element, a conductor 54*c*, contacts 54*d*1 to 54*d*4, and the protection glass layer 54*e*. In the following, the heat generating elements 54*b*1*a*, 54*b*1*b*, 54*b*2, and 54*b*3 may be collectively referred to as "heat generating elements 54*b*". Moreover, the heat generating elements 54*b*1*a* and 54*b*1*b* having substantially the same length in the longitudinal direction may be collectively referred to as "heat generating elements 54*b*1". The substrate 54*a* is made of alumina ($Al_2O_3$) being ceramics. Materials of the ceramic substrate may include, for example, alumina ($Al_2O_3$), aluminum nitride (AlN), zirconia ($ZrO_2$), and silicon carbide (SiC). Among those materials, alumina ($Al_2O_3$) is low in price and can industrially be obtained with ease. Moreover, a metal which is excellent in strength may be used for the substrate 54*a*, and stainless steel (SUS) is excellent in price and strength and thus is suitably used for a metal substrate. In a case in which any of a ceramic substrate and a metal substrate is used as the substrate 54*a*, and the substrate has conductivity, it is required that the substrate be used with an insulating layer provided thereto. The heat generating elements 54*b*1*a*, 54*b*1*b*, 54*b*2, and 54*b*3, the conductor 54*c*, and the contacts 54*d*1 to 54*d*4 are formed on the substrate 54*a*. Further, the protection glass layer 54*e* is formed thereon to secure insulation between the heat generating elements 54*b*1*a*, 54*b*1*b*, 54*b*2, and 54*b*3 and a film 51.

The heat generating elements 54*b* are different in length (hereinafter also referred to as "size") in the longitudinal direction. The heat generating elements 54*b*1*a* and 54*b*1*b* each have a length of L1=222 mm, which is a first length, in the longitudinal direction. The heat generating element 54*b*2 has a length of L2=188 mm, which is a second length, in the longitudinal direction. The heat generating element 54*b*3 has a length of L3=154 mm, which is a third length, in the longitudinal direction. The lengths L1, L2, and L3 have a relationship of L1>L2>L3.

Moreover, the largest sheet width (hereinafter referred to as "maximum sheet width") C in a sheet P which can be used in the image forming apparatus 170 according to Embodiment 1 is 216 mm, and the smallest sheet width (hereinafter referred to as "minimum sheet width") is 76 mm. Thus, the first length L1 is set to such a length that an image size (206 mm) having the maximum sheet width (216 mm) C can be fixed by the heat generating elements 54*b*1. The heat generating elements 54*b*1 are electrically connected to the contact 54*d*2 being a second contact and the contact 54*d*4 being a fourth contact via the conductor 54*c*, and the heat generating element 54*b*2 is electrically connected to the contacts 54*d*2 and 54*d*3 via the conductor 54*c*. The heat generating element 54*b*3 is electrically connected to the contact 54*d*1 being a first contact and the contact 54*d*3 being a third contact via the conductor 54*c*. Here, the heat generating element 54*b*1*a* and the heat generating element 54*b*1*b* have the same lengths and can be always used substantially at the same time. The heat generating element 54*b*1*a* is provided at one end portion in a widthwise direction of the substrate 54*a*, and the heat generating element 54*b*1*b* is provided at another end portion in the widthwise direction of the substrate 54*a*. The heat generating elements 54*b*2 and 54*b*3 are provided between the heat generating element 54*b*1*a* and the heat generating element 54*b*2*b* in the widthwise direction of the substrate 54*a* in such a manner as to be symmetrical with respect to a center in the widthwise direction.

Each of the fixing temperature sensors 59, 60, and 61 is a thermistor. A configuration of the fixing temperature sensor 59 is described with reference to FIG. 4B as a representative configuration of the fixing temperature sensors. The fixing temperature sensor 59 being a first temperature detection unit is formed of a main thermistor element 59*a*, a holder 59*b*, a ceramic paper 59*c*, and an insulation resin sheet 59*d*. The ceramic paper 59*c* has a role of hindering heat conduction between the holder 59*b* and the main thermistor element 59*a*. The insulation resin sheet 59*d* has a role of physically and electrically protecting the main thermistor element 59*a*. The main thermistor element 59*a* is a temperature detecting unit having an output value that is changed in accordance with the temperature of the heater 54, and is connected to the CPU 94 through a Dumet wire (not shown) and wiring. The main thermistor element 59*a* detects the temperature of the heater 54 and outputs a detection result to the CPU 94.

The fixing temperature sensor 59 is located on a surface opposite to the protection glass layer 54*e* over the substrate 54*a*. Further, the fixing temperature sensor 59 is installed in contact with the substrate 54*a* at a position on the reference line "a" (position corresponding to the center) in the longitudinal direction of the heat generating element 54*b*. The CPU 94 is configured to control the temperature at the time of fixing processing based on the detection result of the fixing temperature sensor 59. The above is the description as to the configuration of the fixing temperature sensor 59 being a main thermistor. The configuration of each of the fixing temperature sensors 60 and 61 serving as a pair of second temperature detection units that function as sub-thermistors is the same as that of the fixing temperature sensor 59, and the arrangement position of each of the fixing temperature sensors 60 and 61 in the longitudinal direction is different from that of the fixing temperature sensor 59. Now, the fixing temperature sensor 59 is referred to as "main thermistor 59," and the fixing temperature sensors 60 and 61 are referred to as "sub-thermistors 60 and 61". In addition, the sub-thermistors 60 and 61 are sometimes referred to as "sub-thermistor pair 60 and 61".

[Arrangement of Thermistor]

In FIG. 4A, the broken lines indicate that the main thermistor 59 and the sub-thermistors 60 and 61 are arranged on a back surface of the substrate 54*a*, and indicate positions at which the main thermistor 59 and the sub-thermistors 60 and 61 come into contact with the substrate 54*a*. The CPU 94 is configured to perform temperature control of the heater 54 based on the detection result of the main thermistor 59. The main thermistor 59 is arranged on the reference line "a", which is a center line in the longitudinal direction of the heat generating elements 54*b*1, 54*b*2, and 54*b*3, and which is a center line of the sheet P conveyed to the fixing device 50. Sub-thermistor elements 60*a* and 61*a* of the sub-thermistors 60 and 61 serve as the temperature detection units and as the sheet-width detection units corresponding to the heat generating element 54*b*3, which is a heat generating element having a minimum width. The sub-thermistor elements 60*a* and 61*a* are arranged so as to be bilaterally symmetrical to each other with respect to the reference line "a". In other words, the sub-thermistor elements 60*a* and 61*a* are arranged at positions corresponding to both ends of the heat generating element 54*b*3. An interval (distance) S3 between the sub-thermistor element 60*a* and the sub-thermistor element 61*a* is 142 mm, and L3>S3 is satisfied.

The sheet-width detection of the sheet P by the sub-thermistor elements 60*a* and 61*a* is performed based on a change in temperature detected when the sheet P passes through the fixing nip portion N. Specifically, the CPU 94 serving as a determination unit is configured to determine the sheet width of the sheet P based on a temperature difference between the temperature detected by the main thermistor element 59*a* and the temperatures detected by the sub-thermistor elements 60*a* and 61*a* when the sheet P passes through the fixing nip portion N. For example, when the temperature detected immediately after the sheet P reaches the fixing nip portion N of the fixing device 50 is higher by 10° C. or more than the temperature detected by the main thermistor element 59*a*, the CPU 94 determines the sheet width as follows. In this case, the CPU 94 determines that the sheet P has not passed through the sub-thermistor elements 60*a* and 61*a*, to thereby determine that the sheet width of the sheet P is smaller than S3. When the sheet P has not passed through the sub-thermistor elements 60*a* and 61*a*, the sub-thermistor 60 is denoted by OFF, and the sub-thermistor 61 is denoted by OFF as in a sensor output. When the sheet P has passed through the sub-thermistor elements 60*a* and 61*a*, the sub-thermistor 60 is denoted by ON, and the sub-thermistor 61 is denoted by ON. The CPU 94 is configured to determine timing at which the sheet P has reached the fixing nip portion N based on the timing at which a leading edge of the sheet P has passed through the sheet-width sensors 31 and a process speed (conveyance speed).

[Power Control Unit]

FIG. 5 is a schematic view of a power control circuit for the heater 54 and power controller 97 of the fixing device 50. The power control circuit of the fixing device 50 includes the heat generating elements 54*b*1, 54*b*2 and 54*b*3, the AC power source 55, the triac 56, and the heat generating element switcher 57. Contacts 54*d*1 to 54*d*4 are connected to heat generating element switchers 57 each configured to switch a power supply path. The heat generating element switcher 57 switches the heat generating element 54*b* that generates heat by switching between power supply paths. The switch from one power supply path to another is therefore also expressed as the switch between the heat generating elements 54*b*. In Embodiment 1, the heat generating element switcher 57 specifically corresponds to electromagnetic relays 57*a* and 57*b* that have a transfer contact configuration. The triac 56 is a triac that supplies power or cuts power supply to the heat generating elements 54*b*1, 54*b*2, and 54*b*3 from the AC power source 55 by turning conductive or non-conductive. The CPU 94 calculates, based on temperature information informed by the main thermistor element 59*a*, power required to bring the heater 54 to a predetermined temperature (target temperature required for fixing), and instructs the triac 56 to turn conductive or non-conductive.

The electromagnetic relay 57*a* includes a contact 57*a*1 connected to a first pole of the AC power source 55 through the triac 56, a contact 57*a*2 connected to the contact 54*d*4, and a contact 57*a*3 connected to the contact 54*d*3. Through control of the engine controller 92, the electromagnetic relay 57*a* is brought into any one of a state in which the contact 57*a*1 and the contact 57*a*2 are connected to each other, and a state in which the contact 57*a*1 and the contact 57*a*3 are connected to each other. The electromagnetic relay 57*b* includes a contact 57*b*1 connected to a second pole of the AC power source 55, a contact 57*b*2 connected to the contact 54*d*2, and a contact 57*b*3 connected to the contact 54*d*1. Through control of the engine controller 92, the electromagnetic relay 57*b* is brought into any one of a state in which the contact 57*b*1 and the contact 57*b*2 are connected to each other, and a state in which the contact 57*b*1 and the contact 57*b*3 are connected to each other.

For example, when the contact 57*a*1 and the contact 57*a*2 are connected to each other, and the contact 57*b*1 and the contact 57*b*2 are connected to each other, power is supplied to the heat generating element 54*b*1. For example, when the contact 57*a*1 and the contact 57*a*3 are connected to each other, and the contact 57*b*1 and the contact 57*b*3 are connected to each other (under the state of FIG. 5), power is supplied to the heat generating element 54*b*3. For example, when the contact 57*a*1 and the contact 57*a*3 are connected to each other, and the contact 57*b*1 and the contact 57*b*2 are connected to each other, power is supplied to the heat generating element 54*b*2.

(Regarding Switching of Heat Generating Element and Power Energization Ratio)

The electromagnetic relays 57*a* and 57*b* are the heat generating element switchers 57 serving as heat generating element control units configured to control a ratio of power supply to the plurality of heat generating elements 54*b* (hereinafter referred to as "power energization ratio"). The heat generating element switchers 57*a* and 57*b* are each configured to receive a signal from the CPU 94 to exclusively select a heat generating element 54*b* to which power is to be supplied, from the heat generating elements 54*b*1, 54*b*2, and 54*b*3. In order to achieve a predetermined power energization ratio, the CPU 94 is configured to switch the electromagnetic relays 57*a* and 57*b* to allocate time for power supply to the heat generating elements 54*b*1, 54*b*2, and 54*b*3 (hereinafter referred to as "power energization time"). The CPU 94 is configured to switch the electromagnetic relays 57*a* and 57*b* for each predetermined cycle of the AC power source 55, for example, each four cycles. For example, when the power energization ratio of the heat generating elements 54*b*1*a* and 54*b*1*b* is 2, and the power energization ratio of the heat generating element 54*b*2 is 8, the CPU 94 performs control as follows. First, the CPU 94 continues the state connected to the heat generating element 54*b*1 for 8 cycles (four cycles×2) through use of the electromagnetic relays 57*a* and 57*b*. After that, the CPU 94 repeats an operation involving switching the electromagnetic relays 57*a* and 57*b*, continuing the state connected to the heat generating element 54*b*2 for 32 cycles (four cycles×8), and performing connection to the heat generating element 54*b*1. The case in which the power energization ratio of the heat generating elements 54*b*1*a* and 54*b*1*b* is 2 and the power energization ratio of the heat generating element 54*b*2 is 8 is hereinafter denoted by "power energization ratio 2:8".

In Embodiment 1, the predetermined power energization ratio is achieved by allocating the energization time to the heat generating elements 54*b*, but the method of distributing the power supply to the heat generating elements 54*b* is not limited thereto. It is only required that the power amount supplied to each of the heat generating elements 54*b* be distributed based on any one of time, voltage, and current, or a combination thereof. For example, the following may be performed. Each of the heat generating elements 54*b* is provided with a triac as the heat generating element control unit, and the conduction and non-conduction of each triac is switched by the CPU 94 to control a current amount supplied to each of the heat generating elements 54*b*, to thereby achieve the predetermined power energization ratio.

[Positional Relationship Between Heat Generating Element and Sheet-Width Sensor]

Figure 6:
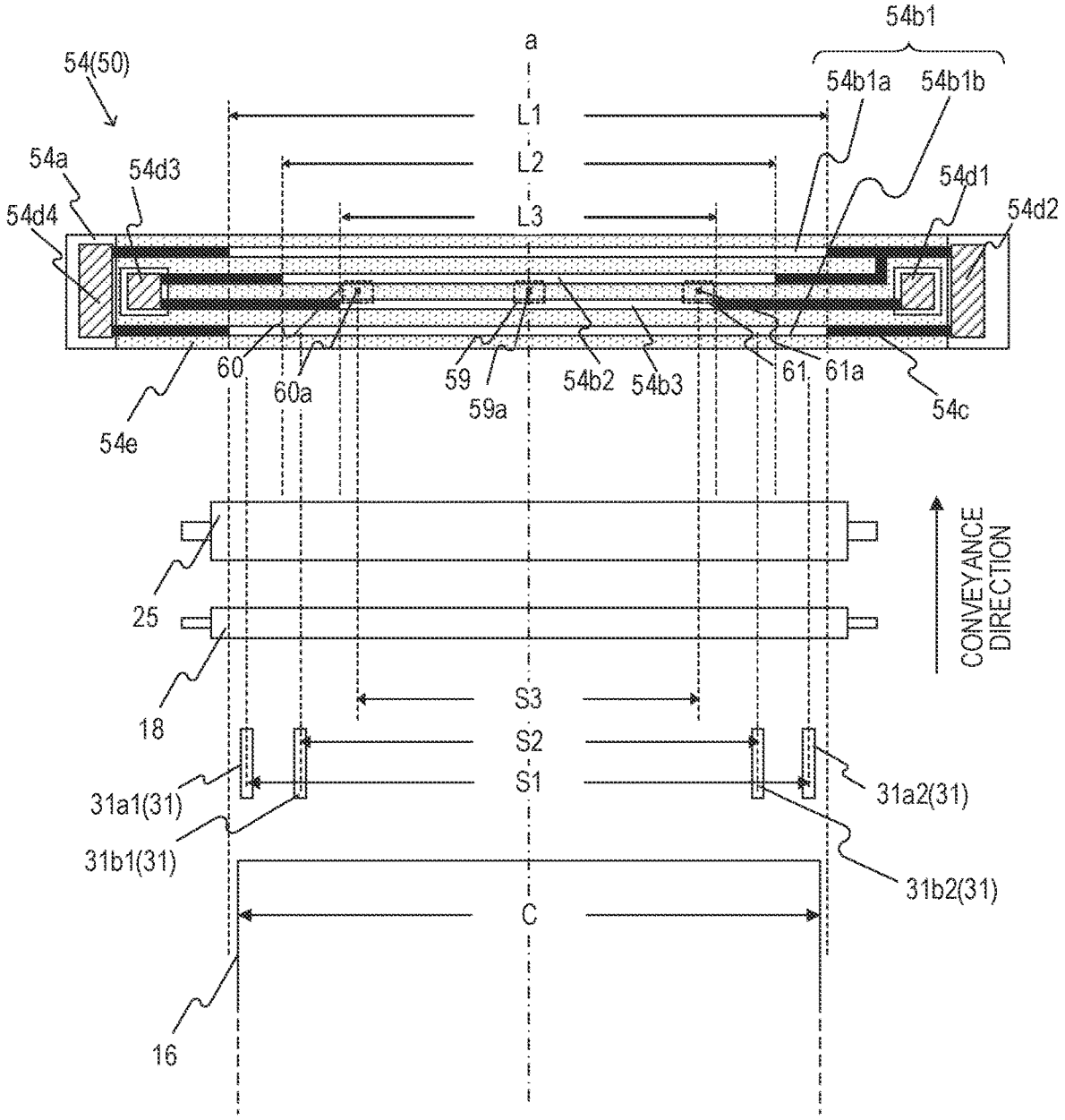
FIG. 6 is a schematic view for illustrating a positional relationship in a longitudinal direction between sheet-width sensors and heat generating elements in Embodiment 1.

The positional relationship between each of the heat generating elements 54*b* and the sheet-width sensors 31 is described with reference to FIG. 6. FIG. 6 is a schematic diagram for illustrating the positional relationship of the image forming apparatus 170 on the conveyance path Y of the sheet P. On the conveyance path Y, the feed cassette 16, the sheet-width sensors 31, the registration roller 18, the secondary transfer roller 25, and the fixing device 50 are arranged in the stated order from an upstream side in the conveyance direction of the sheet P. In FIG. 6, only the heater 54 is schematically illustrated as the fixing device 50. In addition, in Embodiment 1, three pairs of sheet-width sensors 31 corresponding to each of the heat generating elements 54*b* are provided. As the sheet-width sensors 31 corresponding to the heat generating element 54*b*1 having a maximum width in the heat generating elements 54*b*, sheet-width sensors 31*a*1 and 31*a*2 serving as a pair of first sheet-width detection units are arranged at an interval (distance) S1. Specifically, the sheet-width sensors 31*a*1 and 31*a*2 are a pair of sensors, which are provided on an upstream side of the fixing device 50 in the conveyance direction of the sheet P substantially orthogonal to the longitudinal direction, and which are provided at positions corresponding to both ends of the heat generating element 54*b*1*a*. As the sheet-width sensors 31 corresponding to the heat generating element 54*b*2, which is the second longest in the heat generating elements 54*b*, sheet-width sensors 31*b*1 and 31*b*2 serving as a pair of second sheet-width detection units are arranged at an interval (distance) S2. The sheet-width sensors 31*a*1 and 31*a*2 are hereinafter sometimes referred to as "sheet-width sensor pair 31*a*", and the sheet-width sensors 31*b*1 and 31*b*2 are hereinafter sometimes referred to as "sheet-width sensor pair 31*b*". In addition, the sub-thermistor elements 60*a* and 61*a*, which function as the sheet-width sensors corresponding to the heat generating element 54*b*3 having a minimum width in the heat generating elements 54*b*, and which are used for temperature control, are arranged in the fixing nip portion N of the fixing device 50 at the interval S3 as described also with reference to FIGS. 4A and 4B. The sub-thermistor elements 60*a* and 61*a* are also encompassed in the sheet-width sensors 31.

The above-mentioned three pairs of sheet-width sensors 31 are each arranged so as to be bilaterally symmetrical to each other with respect to the reference line "a", which is a center line in the longitudinal direction of the sheet P, and which is a center line of the heat generating elements 54*b*1, 54*b*2, and 54*b*3. The relationship among the lengths L1, L2, and L3 of the respective heat generating elements 54*b*, the intervals S1, S2, and S3 of the respective sheet-width sensors 31, and the maximum sheet width C that can be arranged in the feed cassette 16 are as follows.

L1 (222 mm)>C (216 mm)>S1 (198 mm)>L2 (188 mm)>S2 (170 mm)>L3 (154 mm)>S3 (142 mm)

That is, the sheet-width sensors 31 corresponding to the respective heat generating elements 54*b* are arranged on an inner side in the longitudinal direction of the respective corresponding heat generating elements 54*b*.

As described above, in Embodiment 1, the sub-thermistor elements 60*a* and 61*a* serving as the sheet-width sensors 31 located on an innermost side in the longitudinal direction in the plurality of sheet-width sensors 31 also serve as the temperature detection units configured to detect the temperature of the heater 54. In addition, the sub-thermistor elements 60*a* and 61*a* serving as the sheet-width sensors 31 are arranged in the fixing nip portion N. Meanwhile, the sheet-width sensor pairs 31*a* and 31*b*, which are the sheet width sensors 31 other than the sheet-width sensors 31 (sub-thermistor elements 60*a* and 61*a*) located on the innermost side in the longitudinal direction, are arranged on the upstream side of the fixing nip portion N in the conveyance direction of the sheet P.

The sheet-width detection of the sheet P by the sub-thermistor elements 60*a* and 61*a* is performed at timing at which the leading edge of the first sheet P for continuous printing has reached the fixing nip portion N of the fixing device 50. The detection results of the sheet width of the sheet P in the fixing nip portion N are used for control of the heat generating elements 54*b* in the second and subsequent sheets for continuous printing. In addition, the sheet-width detection by the sheet-width sensor pairs 31*a* and 31*b* is performed at timing at which the leading edge of the sheet P has reached the sheet-width sensor pairs 31*a* and 31*b*, and the detection result thereof is used for control of the heat generating elements 54*b* in the first and subsequent printing.

[Control of Heat Generating Element]

Next, the operation of the fixing device 50 in Embodiment 1 is described with reference to FIG. 7 and Table 1. Here, when the sheet width of the sheet P is represented by "p", the sheet P having the sheet width "p" that satisfies the relationship: "maximum sheet width C (216 mm)≥p≥S1 (198 mm)" is referred to as "large-size sheet", which is a first recording material having a width within a first range. The sheet P having the sheet width "p" that satisfies the relationship: "S1 (198 mm)>p≥S2 (170 mm)" is referred to as "medium-size sheet", which is a second recording material having a width within a second range. The sheet P having the sheet width "p" that satisfies the relationship: "S2 (170 mm)>p≥S3 (142 mm)" is referred to as "small-size sheet", which is a third recording material having a width within a third range. The sheet P having the sheet width "p" that satisfies the relationship: "S3 (142 mm)>p≥minimum sheet width (76 mm)" is referred to as "very small-size sheet" that is a fourth recording material having a width within a fourth range. Typical examples of the large-size sheet include LTR and A4 paper. A typical example of the medium-size sheet is B5 paper. A typical example of the small-size sheet is A5 paper. A typical example of the very small-size sheet is a postcard.

In Table 1, "ON" indicates a state in which each of the sheet-width sensors 31 detects "presence" of the sheet P, and "OFF" indicates a state in which each of the sheet-width sensors 31 detects "absence" of the sheet P. In addition, "TPD" in Table 1 indicates "throughput down", and relates to decreasing a throughput (printed number of sheets per unit time), that is, decreasing the conveyance speed of the sheet P. The control of decreasing a throughput is hereinafter sometimes referred as "TPD control".

Figure 7:
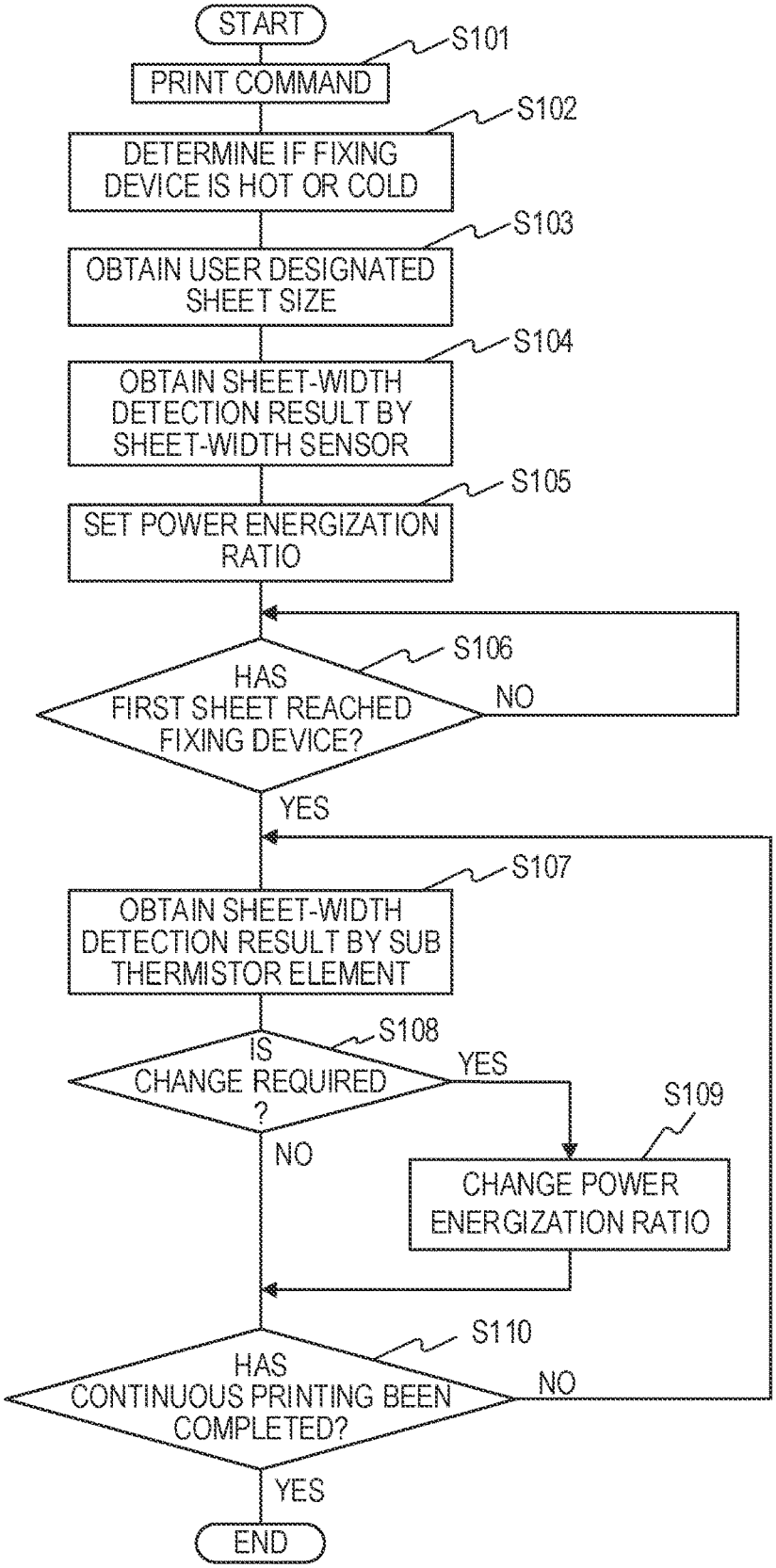
FIG. 7 is a flowchart for illustrating control processing of the fixing device in Embodiment 1.

FIG. 7 is a flowchart for illustrating a sequence from the reception of a print command to the end of printing. In Step S101, the CPU 94 receives a print command from the PC 110. In Step S102, the CPU 94 obtains a detection temperature of the main thermistor 59 of the fixing device 50. When the CPU 94 determines that the detection temperature of the main thermistor 59 is, for example, 70° C. or more, the CPU 94 determines that the state of the fixing device 50 is a HOT state. When the CPU 94 determines that the detection temperature is less than 70° C. (less than the predetermined temperature), the CPU 94 determines that the state of the fixing device 50 is a COLD state.

(HOT State and COLD State)

In this case, when the CPU 94 determines that the fixing device 50 is in the COLD state in Step S102, the CPU 94 performs a fixing operation on the first three sheets P for continuous printing through use of only the heat generating element 54*b*1 irrespective of the detection results of the sheet width and the designated sheet size. Then, the CPU 94 performs control on the fourth and subsequent sheets P at power energization ratios shown in Table 1. In addition, when the CPU 94 determines that the fixing device 50 is in the HOT state in Step S102, the CPU 94 performs control from the first sheet for continuous printing at the power energization ratios shown in Table 1. The reason for performing fixing processing on the first three sheets P through use of only the heat generating element 54*b*1 in the COLD state is to uniformly dissolve grease in the film 51 in the longitudinal direction of the fixing nip portion N. When temperature unevenness occurs to form low-temperature portions in the longitudinal direction of the film 51, there is a risk in that the sliding resistance of the film 51 may become non-uniform in the longitudinal direction to deform the film 51. In addition, as described later with reference to Table 1, also in the fourth and subsequent sheets in the COLD state and in the HOT state, the heat generating element 54*b*1, which is a heat generating element having the largest width, is energized with a certain ratio. With this, the sliding resistance is prevented from becoming non-uniform to deform the film 51 due to a decrease in temperature in the fixing nip portion N.

The description is returned to the flowchart of FIG. 7. In Step S103, the CPU 94 obtains a sheet size designated by a user. When the sheet P is conveyed from the feed cassette 16, the CPU 94 obtains detection results of a sheet width (hereinafter referred to as "sheet-width detection results") of the sheet P by the sheet-width sensors 31 in Step S104. The sheet-width sensors 31 in this case refer to the sheet-width sensor pairs 31*a* and 31*b* provided on the upstream side of the fixing nip portion N. In Step S105, the CPU 94 sets a power energization ratio based on the sheet size designated by the user obtained in Step S103 and the sheet-width detection results obtained in Step S104. In Step S106, the CPU 94 determines if it is timing when the first sheet P has reached the fixing nip portion N based on the detection results of the sheet-width sensor pairs 31*a* and 31*b* and a process speed. When the CPU 94 determines that it is not timing when the sheet P has reached the fixing nip portion N in Step S106, the flow is returned to Step S106. When the CPU 94 determines that it is timing when the sheet P has reached the fixing nip portion N, the flow is advanced to Step S107.

In Step S107, the CPU 94 obtains (determines) a sheet width of the sheet P based on detection results of the sub-thermistor elements 60*a* and 61*a* serving as the sheet-width sensors 31. In Step S108, the CPU 94 determines whether or not it is required to change the power energization ratio based on the designated sheet size obtained in Step S103 and the sheet-width detection results obtained in Step S107. When the CPU 94 determines that it is required to change the power energization ratio in Step S108, the flow is advanced to Step S109. When the CPU 94 determines that it is not required to change the power energization ratio in Step S108, the flow is advanced to Step S110. As described above, when the CPU 94 determines that the fixing device 50 is in the COLD state in Step S102, the CPU 94 performs control using the heat generating element 54*b*1 up to the third sheet P irrespective of the sheet-width detection results and the designated sheet size. In Step S109, the CPU 94 changes the power energization ratio, and the flow is advanced to Step S110. In Step S110, the CPU 94 determines whether or not the continuous printing has been completed. When the CPU determines that the continuous printing has not been completed, the flow is returned to Step S107. When the CPU 94 determines that the continuous printing has been completed, the flow is finished.

[Control of Power Energization Ratio]

Next, the control of a power energization ratio by the CPU 94 shown in Table 1 is described. Regarding the sheet-width detection results in Table 1, the case in which each of the sheet-width sensors 31 detects the arrival of the sheet P is denoted by "ON", and the case in which each of the sheet-width sensors 31 does not detect the arrival of the sheet P is denoted by "OFF". For example, when it is determined that the sheet P has passed through all the sheet-width sensors 31 (all the cases are denoted by "ON"), the sheet-width detection results are determined to indicate a large-size sheet. Further, when the designated sheet size indicates a large-size sheet, the control of the case (a) in Table 1 is performed. In addition, numerical numbers shown in Table 1 indicate ratios for energizing the respective heat generating elements 54*b*1, 54*b*2, and 54*b*3 (hereinafter referred to as "power energization ratios"). For example, in the case (a), 10:0:0 is shown, and informs that the power energization ratio of the heat generating element 54*b*1 is 10, the power energization ratio of the heat generating element 54*b*2 is 0, and the power energization ratio of the heat generating element 54*b*3 is 0. As described above, for example, the power energization ratio of 2:3:5 is that the control is performed as follows. Specifically, the power energization ratio of 2:3:5 involves supplying power to the heat generating element 54*b*1 during 2 cycles of an AC voltage of the AC power source 55, then switching the heat generating element 54*b* to supply power to the heat generating element 54*b*2 during 3 cycles, and switching the heat generating element 54*b* to supply power to the heat generating element 54*b*3 during 5 cycles.

TABLE 1

| Sheet-width detection results | Sheet-width sensor detection results | | | | | | Designated sheet size | | | |
|---|---|---|---|---|---|---|---|---|---|---|
| | 31a1 | 31a2 | 31b1 | 31b2 | 60a | 61a | Large-size sheet | Medium-size sheet | Small-size sheet | Very small-size sheet |
| Large-size sheet | ON | ON | ON | ON | ON | ON | (a) 10:0:0 | (b) 10:0:0 | (c) 10:0:0 | (d) 10:0:0 |
| Medium-size sheet | OFF | OFF | ON | ON | ON | ON | (e) 10:0:0/ Uniform TPD | (f) 4:6:0 to 2:8:0/ Ratio control in accordance with designated sheet size | (g) 2:8:0 | (h) 2:8:0 |
| Small-size sheet | OFF | OFF | OFF | OFF | ON | ON | (i) 2:8:0/ Uniform TPD | (j) 2:8:0/ Uniform TPD | (k) 2:3:5 to 2:0:8/ Ratio control in accordance with designated sheet size | (l) 2:0:8 |
| Very small-size sheet | OFF | OFF | OFF | OFF | OFF | OFF | (m) 2:8:0 ↓ 2:0:8 ↓ TPD in accordance with sheet width | (n) 2:8:0 ↓ 2:0:8 ↓ TPD in accordance with sheet width | (o) 2:3:5 to 2:0:8 ↓ 2:0:8 ↓ TPD in accordance with sheet width | (p) 2:0:8 ↓ TPD in accordance with sheet width |

(Table 1: Selection of Heat Generating Element 54b in HOT state in Embodiment 1)
(Case in which sheet-width detection results and designated sheet size are matched with each other)

First, the case in which the sheet-width detection results and the designated sheet size are matched with each other is described. This corresponds to the cases (a), (f), (k), and (p) in Table 1.

When both the sheet-width detection results and the designated sheet size indicate a large-size sheet (case (a)), the power energization ratio is 10:0:0 as shown in the case (a), and the fixing operation is performed through use of only the heat generating element 54*b*1. The sheet-width detection results in the large-size sheet are ON in the sheet-width sensor pair 31*a*, ON in the sheet-width sensor pair 31*b*, and ON in the sub-thermistor elements 60*a* and 61*a*.

When both the sheet-width detection results and the designated sheet size indicate a medium-size sheet (case (f)), the power energization ratio falls within a range of from 4:6:0 to 2:8:0 as shown in the case (f), and ratio control is performed in accordance with the designated sheet size. In any case, the heat generating element 54*b*1 and the heat generating element 54*b*2 are each caused to generate heat at a certain energization ratio, and the heat generating element 54*b*3 is not caused to generate heat. The sheet-width detection results in the medium-size sheet are OFF in the sheet-width sensor pair 31*a*, ON in the sheet-width sensor pair 31*b*, and ON in the sub-thermistor elements 60*a* and 61*a*.

In this case, the heat generated by the heat generating element 54*b*1 is supplied also to a region on an outer side of the medium-size sheet. In the outer side region of the medium-size sheet, heat is not absorbed by the sheet P or toner, and hence the temperature is liable to be excessively increased. Therefore, when the power energization ratio of the heat generating element 54*b*1 is increased, a non-sheet passing portion temperature rise becomes more conspicuous. When the non-sheet passing portion temperature rise becomes conspicuous, there is a risk in that breakage of the film 51 and the pressure roller 53 may occur, and hence it is required to decrease a throughput by increasing intervals of the sheets P so that the non-sheet passing portion temperature rise reaches a certain temperature or less. Meanwhile, the heat generating element 54*b*2 supplies heat only to a region on an inner side of the medium-size sheet, which is advantageous for the non-sheet passing portion temperature rise. However, when toner is formed on the sheet P in a region having the length L2 or more of the heat generating element 54*b*2, there is a risk in that heat supply may become insufficient in the region having the length L2 or more. Therefore, when the power energization ratio of the heat generating element 54*b*2 is increased, a phenomenon called "poor fixing", in which toner is not fixed occurs in a sheet end portion, with the result that there is a risk in that the toner may adhere to the film 51 to contaminate the fixing device 50, and may be discharged onto a subsequent sheet to contaminate the sheet P. In view of the foregoing, it is preferred that the power energization ratio of the heat generating element 54*b*1 be increased as the sheet width of the sheet P is larger in the same medium-size sheets, and the power energization ratio of the heat generating element 54*b*2 be increased as the sheet width is smaller in the same medium-size sheets. In Embodiment 1, also in the medium-size sheets, the power energization ratio is set so as to fall within a range of from 4:6:0 to 2:8:0 in accordance with the designated sheet size. With the setting as described above, breakage of the film 51 and the pressure roller 53 caused by the non-sheet passing portion temperature rise, and poor fixing in the sheet end portion did not occur irrespective of the designated sheet size.

When both the sheet-width detection results and the designated sheet size indicate a small-size sheet (case (k)), the power energization ratio falls within a range of from 2:3:5 to 2:0:8 as shown in the case (k), and ratio control is performed in accordance with the designated sheet size. In this case, the heat generating element 54*b*1, the heat generating element 54*b*2, and the heat generating element 54*b*3 are each caused to generate heat at a certain power energization ratio. A reason to energize the heat generating element 54*b*1 includes working towards preventing deformation of the film 51 caused by the sliding resistance fluctuation in the longitudinal direction described above, and the power energization ratio is constant at 2, irrespective of the sheet width of the small-size sheet. Then, the power energization ratios of the heat generating element 54*b*2 and the heat generating element 54*b*3 vary depending on the designated sheet size. Specifically, in order to suppress the non-sheet passing portion temperature rise to the extent possible to increase a throughput, as the sheet width of the sheet P is larger, the power energization ratio of the heat generating element 54*b*2 is increased, and the power energization ratio of the heat generating element 54*b*3 is decreased. The power energization ratio falls within a range of from 2:3:5 to 2:0:8 depending on the designated sheet size. The sheet-width detection results in the small-size sheet are OFF in the sheet-width sensor pair 31*a*, OFF in the sheet-width sensor pair 31*b*, and ON in the sub-thermistor elements 60*a* and 61*a*.

When both the sheet-width detection results and the designated sheet size indicate a very small-size sheet (case (p)), the power energization ratio is 2:0:8 as shown in the case (p), and the TPD control is performed in accordance with the sheet width of the sheet P. The power energization ratio of the heat generating element 54*b*1 is 2, and the power energization ratio of the heat generating element 54*b*3 is 8. The sheet-width detection results in the very small-size sheet are OFF in the sheet-width sensor pair 31*a*, OFF in the sheet-width sensor pair 31*b*, and OFF in the sub-thermistor elements 60*a* and 61*a*.

Here, a case in which the sheet-width detection unit for a minimum width is not a thermistor but a sheet-width sensor in the same manner as in other sheet-width detection units (sheet-width sensor pairs 31*a* and 31*b*) is considered. In this case, it can be detected whether the sheet width of the sheet P is equal to or more than a small-size sheet or a very small-size sheet, but it cannot be detected which size in the very small-size sheet or less the sheet width of the sheet P has. Therefore, in order to prevent deformation of the film 51 and the pressure roller 53 caused by the non-sheet passing portion temperature rise, it is required to uniformly decrease a throughput in accordance with the sheet P having a minimum sheet width in which the non-sheet passing portion temperature rise becomes most conspicuous, and thus productivity is impaired.

Meanwhile, in Embodiment 1, the sub-thermistor elements 60*a* and 61*a*, which serve as the temperature detection units being the sheet-width detection units located on the innermost side, are arranged in the fixing nip portion N. In addition, the sheet-width sensor pairs 31*a* and 31*b*, which are the other sheet-width detection units, are arranged on the upstream side of the fixing nip portion N. With such a configuration, when a very small-size sheet is printed, the non-sheet passing portion temperature rise can be always detected. Then, an optimum throughput can be selected in accordance with the sheet size (sheet width of the sheet P) even in the same very small size to maximize productivity. In Embodiment 1, when any one of the detection temperatures of the sub-thermistors 60 and 61 exceeds, for example, 230° C., a sheet interval is increased to decrease a throughput, to thereby prevent deformation of the film 51. In this case, the sheet interval refers to an interval between a trailing edge of a predetermined sheet P and a leading edge of a subsequent sheet P that is conveyed following the predetermined sheet P. Even in the same very small-size sheets, the non-sheet passing portion temperature rise is increased as the width of the sheet P is smaller, and hence a throughput is further decreased.

[Output Number of Sheets]

Figure 8:
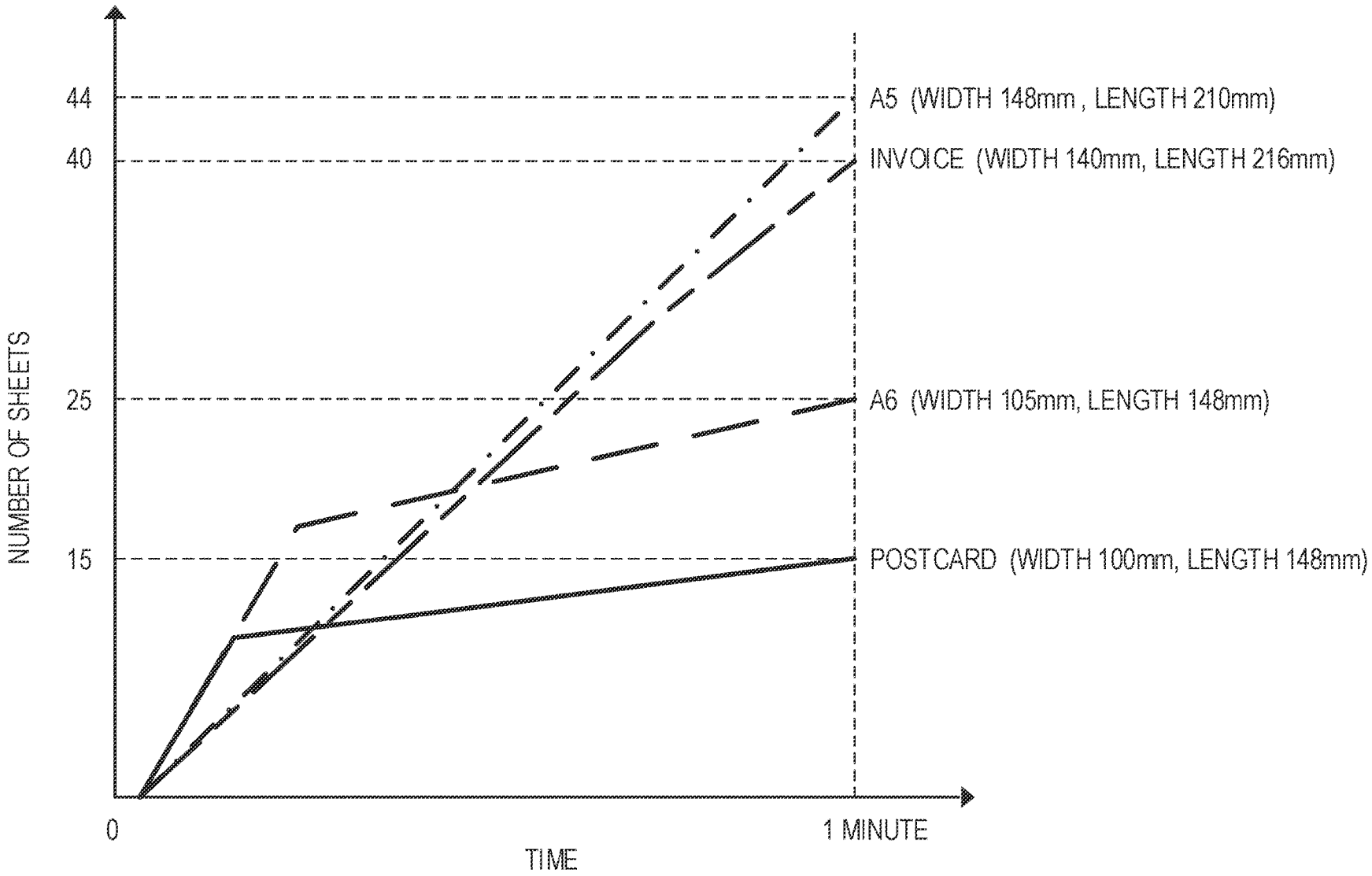
FIG. 8 is a graph for showing a printing speed (number of sheets) of each sheet type in Embodiment 1.

FIG. 8 is a graph for showing an output number of sheets when the sheets P having different sizes are printed for 1 minute from a state in which the detection temperature of the main thermistor 59 of the fixing device 50 is 75° C. (that is, HOT state). In FIG. 8, the horizontal axis represents time (minute), and the vertical axis represents the number of sheets. In addition, the solid line indicates a postcard. The broken line indicates an A6 sheet P. The alternate long and short dash line having a large pitch indicates an invoice. The alternate long and short dash line indicates an A5 sheet P. For example, in the case of the postcard, the detection temperature of the sub-thermistors 60 and 61 exceeds 230° C. after about 10 seconds from the start of printing, and a throughput is decreased. Therefore, the output number of sheets after 1 minute is 15. Meanwhile, in the case of the A5 sheet P, a throughput is not decreased, and the printed number of sheets after 1 minute is 44. The printed number of sheets in the case of the invoice is 40, and the printed number of sheets in the case of the A6 sheet P is 25. It is understood from the graph of FIG. 8 that the printed number of sheets after 1 minute, that is, the output speed is decreased as the sheet has a smaller width, and thus, an appropriate throughput can be selected in accordance with the sheet width. In addition, in any one of the sheet types, when the detection temperature of the sub-thermistors 60 and 61 is kept within a temperature of 230° C., members of the fixing device 50, such as the film 51 and the pressure roller 53, are not deformed.

(Case in Which Sheet-Width Detection Results Indicate a Size Smaller than Designated Sheet Size)

Next, the case in which the sheet-width detection results indicate a size smaller than the designated sheet size is described. This case corresponds to the cases (e), (i), (j), (m), (n), and (o) in Table 1. Embodiment 1 has a feature in that, when the sheet-width detection results indicate a size smaller than the designated sheet size, the power energization ratio of the heat generating element 54*b* having a width in the longitudinal direction larger than the width determined by the sheet-width detection results is increased as compared to the case in which the designated sheet size is matched with that indicated by the sheet-width detection results.

When the sheet-width detection results indicate a medium-size sheet, and the designated sheet size corresponds to a large-size sheet (case (e)), the TPD control is uniformly performed at the power energization ratio of 10:0:0 as shown in the case (e). In this case, only the heat generating element 54*b*1 is energized. When the designated sheet size corresponds to a large-size sheet, an image size is at most 206 mm. When the sheet-width detection results indicate a medium-size sheet, the sheet width is equal to or more than S2 (170 mm) and equal to or less than S1 (198 mm), and hence the sheet width is smaller than the image size. Then, a toner image is formed also on a margin portion of the sheet P depending on the image data. In this case, when the fixing operation is performed at the same power energization ratio as that in the case in which the sheet-width detection results and the designated sheet size are correctly matched with each other (case (f)) such as to a predetermined standard, heat is unnecessarily taken away by the toner image in the margin portion, and there is a risk in that poor fixing may occur in the sheet end portion. However, in Embodiment 1, the power energization ratio of the heat generating element 54*b*1 corresponding to a large-size sheet larger than the medium-size sheet determined by the sheet-width detection results is increased as compared to the case of the case (f), in which the designated sheet size is matched with the sheet-width detection results. Therefore, poor fixing did not occur even in the margin portion. In addition, the non-sheet passing portion temperature rise was also suppressed by decreasing a throughput, and the film 51 was not deformed.

When the sheet-width detection results indicate a small-size sheet, and the designated sheet size corresponds to a large-size sheet (case (i)), the fixing operation is performed at the power energization ratio of 2:8:0 as shown in the case (i), and the TPD control is uniformly performed. The power energization ratio of the heat generating element 54*b*2 is increased as compared to the case of the case (k), in which the designated sheet size is matched with the sheet-width detection results, and hence poor fixing did not occur in the margin portion. In addition, in this case, a throughput is uniformly decreased in the same manner as in the case (e). Also in the case (i), poor fixing and deformation of the film 51 caused by temperature unevenness did not occur. When the sheet-width detection results indicate a small-size sheet, and the designated sheet size corresponds to a medium-size sheet (case (j)), the same operation as that of the case (i) is performed.

When the sheet-width detection results indicate a very small-size sheet, and the designated sheet size corresponds to a large-size sheet (case (m)), the fixing operation in accordance with the printed number of sheets is performed, and in addition, the TPD control in accordance with the sheet width is performed. Specifically, the fixing operation is performed at the power energization ratio of 2:8:0 in the first sheet P for continuous printing, and the fixing operation is performed at the power energization ratio of 2:0:8 in the second and subsequent sheets P. In the first sheet P, only the detection results of the sheet-width sensor pairs 31*a* and 31*b* can be used. Therefore, the CPU 94 can determine that the sheet P that is being conveyed has a size equal to or less than a small size, but cannot determine whether the sheet P is a small-size sheet or a very small-size sheet. Therefore, even when the first sheet P is a small-size sheet, the power energization ratio is set to the same as that in the case (i) so that poor fixing does not occur in the margin portion. In the second and subsequent sheets P for continuous printing, the sub-thermistor elements 60*a* and 61*a* detect that the sheet P is a very small-size sheet. Therefore, in order to suppress the sheet-passing portion temperature rise, the power energization ratio of the heat generating element 54*b*2 is decreased, and the power energization ratio of the heat generating element 54*b*3 is increased, to thereby change the power energization ratio from 2:8:0 to 2:0:8. Further, in order to prevent the non-sheet passing portion temperature rise, a throughput is decreased in accordance with the detection temperatures of the sub-thermistor elements 60*a* and 61*a*, that is, in accordance with the sheet width of the sheet P. Specifically, a throughput is decreased when any of the detection temperatures of the sub-thermistor elements 60*a* and 61*a* reaches 230° C. In the first sheet P, the power energization ratio of the heat generating element 54*b*2 is increased as compared to the case (p), in which the designated sheet size is matched with the sheet-width detection results, and hence poor fixing did not occur even in the margin portion. When the sheet-width detection results indicate a very small-size sheet, and the designated sheet size corresponds to a medium-size sheet (case (n)), the same operation as that of the case (m) is performed.)

When the sheet-width detection results indicate a very small-size sheet, and the designated sheet size corresponds to a small-size sheet (case (o)), the same control as that of the case (k) is performed on the first sheet P (sheet P that has not been determined for whether the sheet P is a small-size sheet or a very small-size sheet). After that, the TPD control is performed on the second and subsequent sheets P (sheets P that have been determined to be very small-size sheets) at the power energization ratio of 2:0:8 in accordance with the detection results of the sub-thermistor elements 60*a* and 61*a*, that is, in accordance with the sheet width of the sheet P. (Case in which sheet-width detection results indicate a size larger than designated sheet size)

Next, the case in which the sheet-width detection results indicate a size larger than the designated sheet size is described. This case corresponds to the cases (b), (c), (d), (g), (h), and (l) in Table 1.

When the sheet width detection results indicate a large-size sheet, and the designated sheet size corresponds to a medium-size sheet (case (b)), the fixing operation is performed at the power energization ratio of 10:0:0 through use of only the heat generating element 54*b*1. The sheet width of the sheet P to be conveyed is larger than the designated sheet size. Therefore, as compared to the case in which the sheet P is conveyed in accordance with the designated sheet size, heat is unnecessarily taken away to decrease the temperature in a region on an outer side of the designated sheet size. Then, the heat in the image size of the designated sheet size also moves to the outer side region in which the temperature is relatively low. Therefore, when the power energization ratio is set in accordance with the designated sheet size (from 4:6:0 to 2:8:0 in the same manner as in the case (f)), there is a risk in that the temperature in the fixing nip portion N in the end portion of the image size may be decreased to cause poor fixing. Further, as a result of the decrease in temperature of the fixing nip portion N, there is also a risk in that fluctuation in the longitudinal direction may occur in the sliding resistance in the film 51 to deform the film 51. In order to prevent poor fixing in the end portion and deformation of the film 51, the following control is required. Specifically, it is required to further increase the power energization ratio of the heat generating element 54*b* on an outer side as compared to the case in which the designated sheet size is determined for whether the sheet P is a large-size sheet or a medium-size sheet before the sheet P reaches the fixing nip portion N, and further, the sheet-width detection results are matched with the designated sheet size.

Embodiment 1 has a feature in that the sheet-width sensor pairs 31*a* and 31*b* serving as the sheet-width detection units other than the sheet-width detection units located on the innermost side are arranged on the upstream side of the fixing nip portion N. Therefore, it can be detected that the sheet P having passed has a width larger than the designated sheet size before the sheet P reaches the fixing nip portion N. In addition, in Embodiment 1, the power energization ratio of the heat generating element 54*b* is set to 10:0:0, which is larger than that used when the sheet-width detection results are matched with the designated sheet size (the case (f) in this case). With such a configuration and control, poor fixing and deformation of the film 51 caused by a decrease in temperature of the fixing nip portion N did not occur.

In addition, in Embodiment 1, the power energization ratio is set to 10:0:0, but may be set to 10:0:0 or less and 4:6:0 or more within a range in which poor fixing and deformation of the film 51 do not occur. A decrease in temperature causes poor fixing and deformation of the film 51. However, when the power energization ratio of the heat generating element 54*b*1 is excessively increased, the temperature of the fixing nip portion N in the vicinity of the sheet end portion in which there is no image is increased to cause energy loss. Specifically, the effect of reducing power consumption is obtained by decreasing the power energization ratio of the heat generating element 54*b*1 to, for example, as low as 4:6:0. When the sheet-width detection results indicate a large-size sheet, and the designated sheet size corresponds to a small-size sheet (case (c)), and when the sheet-width detection results indicate a large-size sheet, and the designated sheet size corresponds to a very small-size sheet (case (d)), the same operation as that of the case (b) is performed.

When the sheet-width detection results indicate a medium-size sheet, and the designated sheet size corresponds to a small-size sheet (case (g)), the fixing operation is performed at the power energization ratio of 2:8:0. When the sheet-width detection results indicate a medium-size sheet, and the designated sheet size corresponds to a very small-size sheet (case (h)), the same operation as that of the case (g) is performed.

When the sheet-width detection results indicate a small-size sheet, and the designated sheet size corresponds to a very small-size sheet (case (1)), the fixing operation is performed at the power energization ratio of 2:0:8. As in this configuration, the sheet-width detection units located on the innermost side may not be arranged on the upstream side of the fixing nip portion N. The reason for this is as follows. The fixing operation is performed through use of the heat generating element 54*b*3 having a minimum width irrespective of ON/OFF of the sheet-width detection units located on the innermost side. Therefore, even when the designated sheet size is erroneously determined between a small-size sheet and a very small-size sheet, a decrease in temperature of the fixing nip portion N is less liable to occur.

As described above, in Embodiment 1, the sheet-width detection units located on the innermost side in the longitudinal direction in the plurality of sheet-width detection units also serve as the temperature detection units, and are arranged in the fixing nip portion N. The sheet-width detection units other than the sheet-width detection units located on the innermost side in the longitudinal direction are arranged on the upstream side of the fixing nip portion N. With such a configuration, when the sheet width of the sheet P is larger than the designated sheet size, an error of the designated sheet size can be detected before the sheet P reaches the fixing nip portion N, and the non-sheet passing portion temperature rise that occurs when the sheet P with a small width has passed can be detected. Therefore, even when the designated sheet size is wrong, an appropriate throughput can be selected in accordance with the width of a small-size sheet to maximize productivity while temperature unevenness in the longitudinal direction is reduced, and further, poor fixing and deformation of the film 51 are prevented.

In addition, in Embodiment 1, when the sheet-width detection results indicate a size smaller than the designated sheet size, the power energization ratio of the heat generating element 54*b* having a width in the longitudinal direction larger than the width determined by the sheet-width detection results is increased as compared to the case in which the designated sheet size is matched with the sheet-width detection results. With this, even when the designated sheet size is wrong, temperature unevenness in the longitudinal direction can be reduced, and further, poor fixing in the sheet end portion and film deformation can be prevented.

As described above, in Embodiment 1, the width of the sheet P is determined based on the detection results of the sheet-width sensors 31*a*1 and 31*a*2, the sheet-width sensors 31*b*1 and 31*b*2, and the fixing temperature sensors 60 and 61. In other words, Embodiment 1 has a configuration in which the ratios of power to be supplied to the heat generating element 54*b*1*a*, the heat generating element 54*b*2, and the heat generating element 54*b*3 is controlled based on the detection results of the sheet-width sensors 31*a*1 and 31*a*2, the sheet-width sensors 31*b*1 and 31*b*2, and the fixing temperature sensors 60 and 61.

Thus, according to Embodiment 1, temperature unevenness in the longitudinal direction of the fixing device can be reduced.

Embodiment 2

Figure 9:
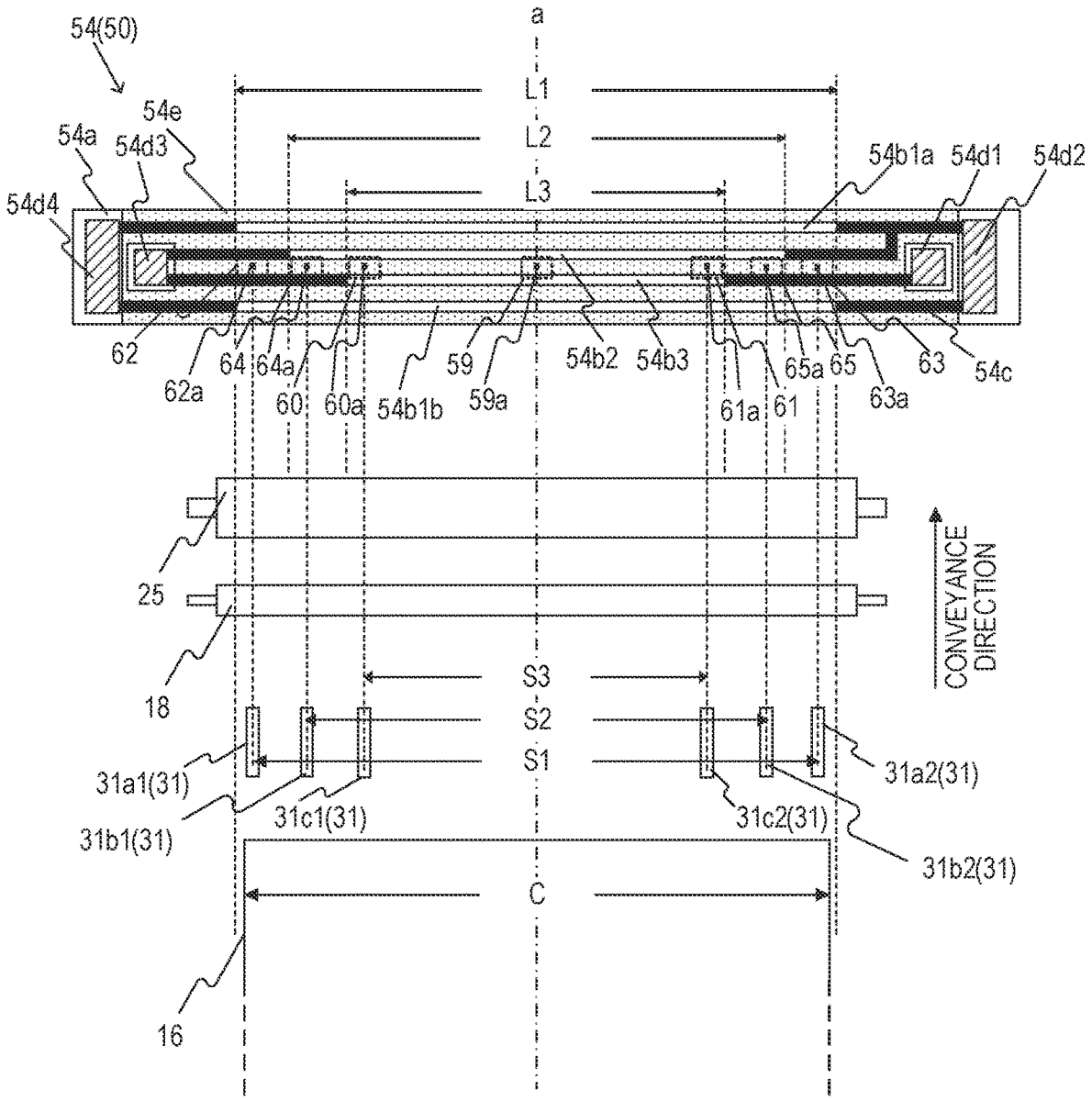
FIG. 9 is a schematic view for illustrating a positional relationship in a longitudinal direction between sheet-width sensors and heat generating elements in Embodiment 2.

Embodiment 2 is described with reference to FIG. 9. Embodiment 2 is different from Embodiment 1 in that a sub-thermistor pair serving as the sheet-width detection unit and the temperature detection unit is added to each of the heat generating element 54*b*1 and the heat generating element 54*b*2, and a sheet-width sensor pair serving as the sheet-detection unit is added to the heat generating element 54*b*3. In the following, only differences from Embodiment 1 are described.

[Positional Relationship Between Heat Generating Element and Sheet-Width Sensor]

The relationship between each of the heat generating elements 54*b* and each of the sheet-width sensors 31 is described with reference to FIG. 9. Sub-thermistors 62 to 65 function as the temperature detection units, and include sub-thermistor elements 62*a* to 65*a*, respectively. The sub-thermistor elements 62*a* and 63*a* each serve as a third temperature detection unit and a sheet-width detection unit corresponding to the heat generating element 54*b*1, and are arranged so as to be bilaterally symmetrical to each other with respect to the reference line "a" at the interval S1 of 198 mm. It can also be said that the sub-thermistor elements 62*a* and 63*a* are provided at positions corresponding to both ends of the heat generating element 54*b*1*a*.

The sub-thermistor elements 64*a* and 65*a* each serve as a fourth temperature detection unit and a sheet-width detection unit corresponding to the heat generating element 54*b*2, and are arranged so as to be bilaterally symmetrical to each other with respect to the reference line "a" at the interval S2 of 170 mm. It can also be said that the sub-thermistor elements 64*a* and 65*a* are provided at positions corresponding to both ends of the heat generating element 54*b*2. The sub-thermistor elements 62*a* to 65*a* are arranged at the center in a widthwise direction of the heater 54 in the same manner as in the sub-thermistor elements 60*a* and 61*a*. All the sub-thermistor elements 60*a* to 65*a* are configured to output detection results to the CPU 94, and the CPU 94 is configured to determine the sheet width of the sheet P based on a change in detection temperature by the sub-thermistor elements 60*a* to 65*a* exhibited when the sheet P has passed in the same manner as in Embodiment 1.

Sheet-width sensors 31*c*1 and 31*c*2, which are third sheet-width detection units, function as sheet-width detection units corresponding to the heat generating element 54*b*3. The sheet-width sensors 31*c*1 and 31*c*2 are arranged so as to be bilaterally symmetrical to each other with respect to the reference line "a" at the interval S3, and are arranged substantially at the same positions as those of the sheet-width sensors 31*a*1 to 31*b*2 on the conveyance path Y. The sheet-width sensors 31*c*1 and 31*c*2 are sometimes referred to as "sheet-width sensor pair 31*c*".

As described above, in Embodiment 2, the sheet-width detection units corresponding to each of the heat generating elements 54*b* are provided in six pairs in total. Specifically, the sheet-width sensor pairs 31*a*, 31*b*, and 31*c* are arranged on the upstream side of the fixing nip portion N, and the sub-thermistor pairs 60 to 65 also serving as the temperature detection units are arranged in the fixing nip portion N. In this case, the sheet-width sensor 31*a*1 corresponds to the sub-thermistor element 62*a*, and the sheet-width sensor 31*a*2 corresponds to the sub-thermistor element 63*a*. The sheet-width sensor 31*b*1 corresponds to the sub-thermistor element 64*a*, and the sheet-width sensor 31*b*2 corresponds to the sub-thermistor element 65*a*. The sheet-width sensor 31*c*1 corresponds to the sub-thermistor element 60*a*, and the sheet-width sensor 31*c*2 corresponds to the sub-thermistor element 61*a*.

[Control of Power Energization Ratio]

Next, an operation of the fixing device 50 in Embodiment 2 is described with reference to Table 2. In Table 2, there is shown control of a power energization ratio performed when the fixing device 50 is in a HOT state. In addition, here, only differences from Embodiment 1 are described.

medium-size sheets in Embodiment 1, there is a risk in that a decrease in temperature may occur in an end portion to cause poor fixing. However, in Embodiment 2, the non-sheet passing portion temperature rise and a decrease in temperature in an end portion can be detected by the sub-thermistor elements 62*a* and 63*a* arranged at positions through which the sheet P does not pass. Therefore, even when the designated sheet size is wrong in the medium-size sheets, an appropriate power energization ratio can be selected.

For example, a case in which a 16K-size sheet P (sheet width: 195 mm) has passed when a B5 (ISO)-size sheet P (sheet width: 176 mm) is designated is considered. In this case, a difference between the designated sheet size and the sheet P that is being actually conveyed cannot be detected by the sheet-width sensors 31*b*1 and 31*b*2. Specifically, in both the B5-size sheet P and the 16K-size sheet P, the sheet-width sensors 31*b*1 and 31*b*2 are in the ON state, and cannot discriminate a difference in size in the medium-size sheets. In Embodiment 2, when the B5-size sheet P is designated, sheet passage is started at the power energization ratio of 2:8:0. Then, the 16K-size sheet P having a width larger than that of the B5-size sheet P has actually passed, and hence the temperature in the end portion of the fixing nip portion N is decreased as compared to the case in which the B5-size sheet P has normally passed.

TABLE 2

| Sheet-width detection results | Sheet-width sensor detection results | | | | | | Designated sheet size | | | |
|---|---|---|---|---|---|---|---|---|---|---|
| | 31a1 · 62a | 31a2 · 63a | 31b1 · 64a | 31b2 · 65a | 31c1 · 60a | 31c2 · 61a | Large-size sheet | Medium-size sheet | Small-size sheet | Very small-size sheet |
| Large-size sheet | ON | ON | ON | ON | ON | ON | (a) 10:0:0 | (b) 10:0:0 | (c) 10:0:0 | (d) 10:0:0 |
| Medium-size sheet | OFF | OFF | ON | ON | ON | ON | (e) 10:0:0 ↓ Ratio control in accordance with sheet width | (f) 4:6:0 to 2:8:0 ↓ Ratio control in accordance with sheet width | (g) 2:8:0 | (h) 2:8:0 |
| Small-size sheet | OFF | OFF | OFF | OFF | ON | ON | (i) 2:8:0 ↓ Ratio control in accordance with sheet width | (j) 2:8:0 ↓ Ratio control in accordance with sheet width | (k) 2:3:5 to 2:0:8 ↓ Ratio control in accordance with sheet width | (l) 2:0:8 |
| Very small-size sheet | OFF | OFF | OFF | OFF | OFF | OFF | (m) 2:0:8 ↓ TPD in accordance with sheet width | (n) 2:0:8 ↓ TPD in accordance with sheet width | (o) 2:0:8 ↓ TPD in accordance with sheet width | (p) 2:0:8 ↓ TPD in accordance with sheet width |

(Table 2: Selection of Heat Generating Element 54b in HOT state in Embodiment 2)
(Case in which sheet-width detection results and designated sheet size are matched with each other)

When both the sheet-width detection results and the designated sheet size correspond to a medium-size sheet (case (f)), the heat generating elements 54*b*1 and 54*b*2 are each caused to generate heat at a certain power energization ratio of from 4:6:0 to 2:8:0, to thereby perform ratio control in accordance with the sheet width. In this case, the non-sheet passing portion temperature rise is smaller as the sheet P has a larger width in the medium-size sheets, and the non-sheet passing portion temperature rise is larger as the sheet P has a smaller width in the medium-size sheets. Therefore, when the designated sheet size is wrong in the In Embodiment 2, when any one of the temperatures of the sub-thermistor elements 62*a* and 63*a* is decreased by 40° C. or more as compared to the main thermistor element 59*a*, the power energization ratio of the heat generating element 54*b*1 is increased, and the power energization ratio of the heat generating element 54*b*2 is decreased. When this control is performed, the power energization ratio of 2:8:0, which is used for starting the control, gradually reaches 4:6:0, for example, by sheet passage of the fourth sheet P, and the decrease in temperature in the fixing nip portion N can be eliminated. In contrast, when the B5-size sheet P has passed in spite of the fact that the 16K-size sheet P is designated, the non-sheet passing portion temperature rise is increased. In Embodiment 2, when any one of the temperatures of the sub-thermistor elements 62*a* and 63*a* reaches 230° C., the power energization ratio of the heat generating element 54*b*1 is decreased, and the power energization ratio of the heat generating element 54*b*2 is increased. Therefore, the power energization ratio of 4:6:0, which is used for starting the control in accordance with the initially designated sheet size of 16K, gradually reaches 2:8:0, for example, by sheet passage of the fourth sheet P, and the non-sheet passing portion temperature rise in the fixing nip portion N can be eliminated.

When both the sheet-width detection results and the designated sheet size correspond to a small-size sheet (case (k)), the control is started at a power energization ratio in accordance with the designated sheet size in the same manner as in Embodiment 1. In addition, in Embodiment 2, in the same manner as in the case (f), even when an error of the size in the small-size sheets occurs, a change in temperature can be detected by the sub-thermistor elements 64*a* and 65*a* arranged at positions through which the sheet P does not pass. Therefore, in the second and subsequent sheets P, sheet passage can be performed at an appropriate power energization ratio in accordance with the sheet width even in the same small-size sheets. The cases (a) and (p) are the same as those in Table 1, and hence description thereof is omitted.

(Case in Which Sheet-Width Detection Results Indicate a Size Smaller than Designated Sheet Size)

A case (e) in which the sheet-width detection results indicate a medium-size sheet, and the designated sheet size corresponds to a large-size sheet is described. In Embodiment 1, when the sheet-width detection results indicate a medium-size sheet, the sheet P having a sheet width of S2 (170 mm) or more and S1 (198 mm) or less cannot be determined. Therefore, even when the sheet P having a maximum sheet width in the medium-size sheets has passed, the power energization ratio is set to 10:0:0 so that a toner image in a margin portion can be fixed, and a throughput is decreased by increasing a sheet interval so as to alleviate the non-sheet passing portion temperature rise (Table 1). In Embodiment 2, the non-sheet passing portion temperature rise can be detected by the sub-thermistor elements 62*a* and 63*a* arranged within a range through which the sheet P does not pass, and hence the power energization ratio can be changed in accordance with the sheet width in the same manner as in the case (f). The power energization ratio is initially set to 10:0:0, and the power energization ratio of the heat generating element 54*b*1 is decreased and the power energization ratio of the heat generating element 54*b*2 is increased in accordance with the non-sheet passing portion temperature rise.

For example, when the B5-size sheet has passed, printing is started at the power energization ratio of 2:8:0 when the designated sheet size corresponds also to the B5-size sheet (case (f)) in Embodiment 2. However, printing is started at the power energization ratio of 10:0:0 when the designated sheet size corresponds to an LTR-size sheet (case (e)). After that, when the non-sheet passing portion temperature rise is increased, and any of the temperatures of the sub-thermistor elements 62*a* and 63*a* reaches 230° C., the power energization ratio of the heat generating element 54*b*1 is decreased, and the power energization ratio of the heat generating element 54*b*2 is increased. For example, in sheet passage of the fourth sheet, the power energization ratio reached the vicinity of 2:8:0, and the non-sheet passing portion temperature rise was eliminated. Even after that, breakage of the film 51 and the pressure roller 53 caused by the non-sheet passing portion temperature rise did not occur. Further, the sub-thermistor elements 62*a* and 63*a* in the end portions are kept in the vicinity of 230° C., and hence poor fixing did not occur even when toner is loaded on the margin portion. Thus, as compared to Embodiment 1, temperature unevenness can be eliminated without decreasing a throughput in Embodiment 2.

When the sheet-width detection results indicate a small-size sheet, and the designated sheet size corresponds to a large-size sheet (case (i)), printing is started at the power energization ratio of 2:8:0. After that, when the detection results of the sub-thermistor elements 64*a* and 65*a* exceed 230° C., the power energization ratio of the heat generating element 54*b*2 is decreased, and the power energization ratio of the heat generating element 54*b*3 is increased. Also in this case, in the same manner as in the case (e), temperature unevenness can be eliminated without decreasing a throughput, and poor fixing and partial breakage caused by the non-sheet passing portion temperature rise did not occur.

When the sheet-width detection results indicate a small-size sheet, and the designated sheet size corresponds to a medium-size sheet (case (j)), the same control as that of the case (i) is performed. Also in this case, in the same manner as in the case (i), temperature unevenness can be eliminated without decreasing a throughput, and poor fixing and partial breakage caused by the non-sheet passing portion temperature rise did not occur.

A case (m) in which the sheet-width detection results indicate a very small-size sheet, and the designated sheet size corresponds to a large-size sheet is described. In Embodiment 1, only the sub-thermistors 60*a* and 61*a* are the sheet-width detection units corresponding to the heat generating element 54*b*3. Therefore, it cannot be determined whether the sheet width corresponds to a small-size sheet or a very small-size sheet until the first sheet P passes through the fixing nip portion N. Therefore, the control is started initially at the power energization ratio of 2:8:0 for a small-size sheet, and the power energization ratio is switched to 2:0:8, which is the power energization ratio for a very small-size sheet, after the first sheet P passes through the fixing nip portion N.

In Embodiment 2, the sheet-width sensors 31*c*1 and 31*c*2 are added on the upstream side in addition to the sub-thermistors 60*a* and 61*a* as the sheet-width detection units corresponding to the heat generating element 54*b*3. Therefore, the CPU 94 can determine that the sheet width corresponds to a very small-size sheet before the first sheet P reaches the fixing nip portion N. Therefore, the control can be performed from the beginning at the power energization ratio of 2:0:8 corresponding to a very small-size sheet, and after that, a throughput is decreased in accordance with an increase in temperature of the sub-thermistor elements 60*a* and 61*a*. In Embodiment 2, heat generated within a range through which the first sheet P did not pass was further reduced, and the non-sheet passing portion temperature rise was decreased, thereby being capable of delaying timing of decreasing a throughput, with the result that initial productivity was improved. In the cases (n) and (o), the same operation as that of the case (m) is performed. When the sheet-width detection results indicate a size larger than the designated sheet size, that is, in the cases (b), (c), (d), (g), (h), and (l), the same control as that described with reference to Table 1 in Embodiment 1 is performed, and hence description thereof is omitted.

As described above, in Embodiment 2, productivity in the case of sheet size mismatch can be improved in addition to the effect of Embodiment 1, and temperature unevenness in the longitudinal direction of the fixing device 50 can be controlled. Thus, according to Embodiment 2, temperature unevenness in the longitudinal direction of the fixing device 50 can be reduced.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus comprising:

a fixing device having a heater that includes a first heat generating element, a second heat generating element having a length smaller than a length of the first heat generating element in a longitudinal direction, and a third heat generating element having a length smaller than the length of the second heat generating element in the longitudinal direction;

a first temperature detection unit provided at a position corresponding to a center of the first heat generating element in the longitudinal direction;

a second temperature detection unit provided at a position corresponding to an end of the third heat generating element;

a first sheet-width detection unit provided upstream of the fixing device in a conveyance direction of a recording material and provided at a position corresponding to an end of the first heat generating element;

a second sheet-width detection unit provided upstream of the fixing device in the conveyance direction and provided at a position corresponding to an end of the second heat generating element; and a control unit configured to control a temperature of the heater based on a detection result of the first sheet-width detection unit, a detection result of the second sheet-width detection unit, and a detection result of the second temperature detection unit.

2. The image forming apparatus according to claim 1, wherein the control unit is configured to control a ratio of power to be supplied to the first heat generating element, the second heat generating element, and the third heat generating element based on a difference between a temperature detected by the first temperature detection unit and a temperature detected by the second temperature detection unit when the recording material reaches the fixing device.

3. The image forming apparatus according to claim 1, further comprising:

a designation unit configured to designate the recording material and designate a size of the recording material; and a determination unit configured to determine a width of the recording material based on the detection result of the first sheet-width detection unit, the detection result of the second sheet-width detection unit, and the detection result of the second temperature detection unit, wherein the control unit is configured to control to set a ratio of power to be supplied to the first heat generating element, the second heat generating element, and the third heat generating element based on the designated recording material size and the determined recording material width, and to control the heater based on the set power ratio.

4. The image forming apparatus according to claim 1, further comprising:

a third temperature detection unit provided at the position corresponding to the end of the first heat generating element;

a fourth temperature detection unit provided at the position corresponding to the end of the second heat generating element; and a third sheet-width detection unit provided upstream of the fixing device in the conveyance direction and provided at the position corresponding to the end of the second heat generating element.

5. The image forming apparatus according to claim 1, wherein the heater includes an elongated substrate on which the first heat generating element, the second heat generating element, and the third heat generating element are arranged, wherein the first heat generating element is arranged on one end portion of the elongated substrate in a widthwise direction of the elongated substrate orthogonal to both a longitudinal direction of the elongated substrate and a thickness direction of the elongated substrate, wherein the heater further includes a fourth heat generating element arranged on another end portion of the elongated substrate in the widthwise direction of the elongated substrate so that the fourth heat generating element is symmetrical to the first heat generating element, and wherein the second heat generating element and the third heat generating element are arranged between the first heat generating element and the fourth heat generating element in the widthwise direction of the elongated substrate.

6. An image forming apparatus comprising:

a fixing device having a heater that includes a first heat generating element, a second heat generating element having a length smaller than a length of the first heat generating element in a longitudinal direction, and a third heat generating element having a length smaller than the length of the second heat generating element in the longitudinal direction;

a first temperature detection unit provided at a position corresponding to a center of the first heat generating element in the longitudinal direction;

a pair of second temperature detection units provided at positions corresponding to both ends of the third heat generating element;

a pair of first sheet-width detection units provided upstream of the fixing device in a conveyance direction of a recording material and provided at positions corresponding to both ends of the first heat generating element;

a pair of second sheet-width detection units provided upstream of the fixing device in the conveyance direction and provided at positions corresponding to both ends of the second heat generating element; and a control unit configured to control a temperature of the heater based on a detection result of the pair of first sheet-width detection units, a detection result of the pair of second sheet-width detection units, and a detection result of the pair of second temperature detection units.

7. The image forming apparatus according to claim 6, wherein the control unit is configured to control a ratio of power to be supplied to the first heat generating element, the second heat generating element, and the third heat generating element based on a difference between a temperature detected by the first temperature detection unit and a temperature detected by the pair of second temperature detection units when the recording material reaches the fixing device.

8. The image forming apparatus according to claim 6, wherein the pair of first sheet-width detection units and the pair of second sheet-width detection units are provided substantially at the same position in the conveyance direction.

9. The image forming apparatus according to claim 6, further comprising:

a designation unit configured to designate the recording material and designate a size of the recording material; and a determination unit configured to determine a width of the recording material based on the detection result of the pair of first sheet-width detection units, the detection result of the pair of second sheet-width detection units, and the detection result of the pair of second temperature detection units, wherein the control unit is configured to control to set a ratio of power to be supplied to the first heat generating element, the second heat generating element, and the third heat generating element based on the designated recording material size and the determined recording material width, and to control the heater based on the set power ratio.

10. The image forming apparatus according to claim 9, wherein, in a case in which the determined recording material width (i) matches the designated recording material size, (ii) is smaller than an interval of the pair of first sheet-width detection units in the longitudinal direction, and (iii) is larger than an interval of the pair of second sheet-width detection units in the longitudinal direction, the control unit controls to set the power ratio in accordance with the designated recording material size.

11. The image forming apparatus according to claim 9, wherein, in a case in which the determined recording material width (i) is smaller than the designated recording material size and (ii) is smaller than an interval of the pair of second sheet-width detection units in the longitudinal direction, the control unit controls the heater by setting the power ratio in accordance with a recording material having the width that is smaller than the interval of the pair of second sheet-width detection units in the longitudinal direction and is larger than an interval of the pair of second temperature detection units in the longitudinal direction, and then, changes the power ratio to a ratio of power in accordance with the determined recording material width based on the detection result of the pair of second temperature detection units.

12. The image forming apparatus according to claim 11, wherein, in a case in which the determined recording material width (i) is smaller than the designated recording material size, (ii) is smaller than an interval in the longitudinal direction of the pair of first sheet-width detection units, and (iii) is larger than the interval of the pair of second temperature detection units in the longitudinal direction, the control unit controls to decrease a conveyance speed of the recording material irrespective of the determined recording material width.

13. The image forming apparatus according to claim 9, wherein, in a case in which the determined recording material width is smaller than an interval of the pair of second temperature detection units in the longitudinal direction, the control unit controls to decrease a conveyance speed of the recording material in accordance with the detection result of the pair of second temperature detection units.

14. The image forming apparatus according to claim 9, wherein, in a case in which the determined recording material width is larger than the designated recording material size and a first heat generating element has a width larger than a width of the designated recording material in the longitudinal direction, the control unit controls to set a ratio of power to be supplied to the first heat generating element to be larger than a ratio of power to be supplied to a second heat generating element used for the designated recording material.

15. The image forming apparatus according to claim 6, further comprising:

a pair of third temperature detection units provided at the positions corresponding to both ends of the first heat generating element;

a pair of fourth temperature detection units provided at the positions corresponding to both ends of the second heat generating element; and a pair of third sheet-width detection units provided upstream of the fixing device in the conveyance direction and provided at positions corresponding to the second heat generating element.

16. The image forming apparatus according to claim 15, wherein the pair of third sheet-width detection units are provided substantially at the same position in the conveyance direction as positions of the pair of first sheet-width detection units and the pair of second sheet-width detection units.

17. The image forming apparatus according to claim 15, further comprising:

a designation unit configured to designate the recording material and designate a size of the recording material; and a determination unit configured to determine a width of the recording material based on the detection result of the pair of first sheet-width detection units, the detection result of the pair of second sheet-width detection units, and the detection result of the pair of second temperature detection units, wherein, in a case in which the determined recording material width (i) matches the designated recording material size, (ii) is smaller than an interval of the pair of first sheet-width detection units in the longitudinal direction, and (iii) is larger than an interval of the pair of third sheet-width detection units in the longitudinal direction, the control unit controls to set a ratio of power in accordance with the detection result of the pair of second temperature detection units.

18. The image forming apparatus according to claim 15, further comprising:

a designation unit configured to designate the recording material and designate a size of the recording material; and a determination unit configured to determine a width of the recording material based on the detection result of the pair of first sheet-width detection units, the detection result of the pair of second sheet-width detection units, and the detection result of the pair of second temperature detection units, wherein, in a case in which the determined recording material width is smaller than the designated recording material size and the determined recording material width is smaller than an interval of the pair of first sheet-width detection units in the longitudinal direction and is larger than an interval of the pair of third sheet-width detection units in the longitudinal direction, the control unit controls to set a ratio of power in accordance with a detection result of the pair of third temperature detection units or a detection result of the pair of fourth temperature detection units.

19. The image forming apparatus according to claim 6, wherein, in a case where a temperature detected by the first temperature detection unit is less than a predetermined temperature when continuous printing is started, the control unit controls to perform fixing processing on a predetermined number of recording materials using the first heat generating element.

20. The image forming apparatus according to claim 6, wherein, in a case in which a difference between a temperature detected by the first temperature detection unit and a temperature detected by the pair of second temperature detection units is a first value, the control unit is configured to control to supply power to the first heat generating element at a first ratio of power, and wherein, in a case in which the difference between the temperature detected by the first temperature detection unit and the temperature detected by the pair of second temperature detection units is a second value larger than the first value, the control unit is configured to control to supply power to the first heat generating element at a second ratio of power smaller than the first ratio of power.

21. The image forming apparatus according to claim 6, wherein the heater includes an elongated substrate on which the first heat generating element, the second heat generating element, and the third heat generating element are arranged, wherein the first heat generating element is arranged on one end portion of the elongated substrate in a widthwise direction of the elongated substrate orthogonal to both a longitudinal direction of the elongated substrate and a thickness direction of the elongated substrate, wherein the heater further includes a fourth heat generating element arranged on another end portion of the elongated substrate in the widthwise direction of the elongated substrate so that the fourth heat generating element is symmetrical to the first heat generating element, and wherein the second heat generating element and the third heat generating element are arranged between the first heat generating element and the fourth heat generating element in the widthwise direction of the elongated substrate.

22. The image forming apparatus according to claim 21, wherein the second heat generating element and the third heat generating element are arranged to be symmetric to each other in the widthwise direction of the elongated substrate.

23. The image forming apparatus according to claim 21, further comprising:

a fourth contact to which one end portion of the first heat generating element and one end portion of the fourth heat generating element are electrically connected;

a second contact to which another end portion of the first heat generating element, another end portion of the fourth heat generating element, and another end portion of the second heat generating element are electrically connected;

a third contact to which one end portion of the second heat generating element and one end portion of the third heat generating element are electrically connected; and a first contact to which another end portion of the third heat generating element is electrically connected.

24. The image forming apparatus according to claim 6, further comprising:

a first rotary member having a film and configured to be heated by the heater; and a second rotary member configured to form a nip portion together with the first rotary member.

25. The image forming apparatus according to claim 24, wherein the heater is provided to be in contact with an inner surface of the film, and wherein the nip portion is formed by sandwiching the film between the heater and the second rotary member.

* * * * *